US010373398B1

(12) United States Patent
McBride et al.

(10) Patent No.: US 10,373,398 B1
(45) Date of Patent: Aug. 6, 2019

(54) SYSTEMS AND METHODS FOR DISTRIBUTED ACTIVATION OF POSTAGE

(75) Inventors: Ken McBride, Hermosa Beach, CA (US); James M. Bortnak, Santa Barbara, CA (US)

(73) Assignee: Stamps.com Inc., El Segundo, CA (US)

( * ) Notice: Subject to any disclaimer, the term of this patent is extended or adjusted under 35 U.S.C. 154(b) by 1071 days.

(21) Appl. No.: 12/030,739

(22) Filed: Feb. 13, 2008

(51) Int. Cl.
*G07B 17/00* (2006.01)

(52) U.S. Cl.
CPC . *G07B 17/00024* (2013.01); *G07B 17/00362* (2013.01); *G06Q 2250/057* (2013.01); *G07B 2017/0037* (2013.01); *G07B 2017/00064* (2013.01); *G07B 2017/00427* (2013.01)

(58) Field of Classification Search
CPC ..... G07B 17/00; G07B 2017/00064; G07B 2017/0037
USPC ..... 705/330
See application file for complete search history.

(56) References Cited

U.S. PATENT DOCUMENTS

| | | | |
|---|---|---|---|
| 1,684,756 | A | 9/1928 | Close |
| 1,988,908 | A | 1/1935 | MacKinnon |
| 2,825,498 | A | 3/1958 | Alves |
| 2,887,326 | A | 5/1959 | Kramer |
| 2,964,232 | A | 12/1960 | Levyn |
| 3,111,084 | A | 11/1963 | Ridenour et al. |
| 3,221,980 | A | 12/1965 | Mercur |
| 3,380,648 | A | 4/1968 | De Lyra |
| 3,584,696 | A | 6/1971 | Eblowitz |
| 3,594,727 | A | 7/1971 | Braun |
| 3,658,239 | A | 4/1972 | Foutz |
| 3,691,726 | A | 9/1972 | Stephens et al. |
| 3,747,837 | A | 7/1973 | Wilson |
| 3,938,095 | A | 2/1976 | Check, Jr. et al. |
| 3,978,457 | A | 8/1976 | Check, Jr. et al. |

(Continued)

FOREIGN PATENT DOCUMENTS

| | | |
|---|---|---|
| DE | 4409388 A1 | 9/1995 |
| EP | 0137737 A2 | 4/1985 |

(Continued)

OTHER PUBLICATIONS

"Domestic Mail Manual Section 604", Aug. 31, 2005.*

(Continued)

*Primary Examiner* — Daniel Vetter
(74) *Attorney, Agent, or Firm* — Norton Rose Fulbright US LLP

(57) ABSTRACT

Systems and methods which provide for distributed activation of pre-printed, or otherwise pre-produced, indicia to thereby provide value bearing indicia, such as postage indicia, are shown. Embodiments apply indicia to fungible items, such as envelopes, paper stock, labels, etc., at a central location. When one of the items bearing the pre-produced indicia is incorporated into a mail item by a user, the pre-produced indicia may be activated and thus becomes valid postage indicia for use in posting the mail item. Various images, information, characters, symbols, and/or marks may be provided in association with pre-produced indicia. Such marks may be printed using a same or different media than an accompanying pre-produced indicia. Embodiments implement a system for scanning pre-produced indicia for activation as postage indicia.

26 Claims, 5 Drawing Sheets

(56) References Cited

U.S. PATENT DOCUMENTS 4,119,194 A 10/1978 Freeman et al.
4,201,339 A 5/1980 Gunn
4,245,775 A 1/1981 Conn
4,253,158 A 2/1981 McFiggans
4,271,481 A 6/1981 Check, Jr. et al.
4,306,299 A 12/1981 Check, Jr. et al.
4,376,299 A 3/1983 Rivest
4,511,793 A 4/1985 Racanelli
4,565,317 A 1/1986 Kranz
4,629,871 A 12/1986 Scribner et al.
4,641,347 A 2/1987 Clark et al.
4,649,266 A 3/1987 Eckert
4,661,001 A 4/1987 Takai et al.
4,709,850 A 12/1987 Wagner
4,725,718 A 2/1988 Sansone et al.
4,743,747 A 5/1988 Fougere et al.
4,744,554 A 5/1988 Kulpa et al.
4,757,537 A 7/1988 Edelmann et al.
4,760,532 A 7/1988 Sansone et al.
4,763,271 A 8/1988 Field
4,775,246 A 10/1988 Edelmann et al.
4,784,317 A 11/1988 Chen et al.
4,800,506 A 1/1989 Axelrod et al.
4,802,218 A 1/1989 Wright et al.
4,812,994 A 3/1989 Taylor et al.
4,821,195 A 4/1989 Baer et al.
4,831,554 A 5/1989 Storace et al.
4,831,555 A 5/1989 Sansone et al.
4,837,701 A 6/1989 Sansone et al.
4,853,865 A 8/1989 Sansone et al.
4,858,138 A 8/1989 Talmadge
4,862,386 A 8/1989 Axelrod et al.
4,864,618 A 9/1989 Wright et al.
4,868,757 A 9/1989 Gil
4,872,705 A 10/1989 Hartfeil
4,872,708 A 10/1989 Brewen et al.
4,873,645 A 10/1989 Hunter et al.
4,875,174 A 10/1989 Olodort et al.
4,893,249 A 1/1990 Silverberg
4,900,903 A 2/1990 Wright et al.
4,900,904 A 2/1990 Wright et al.
4,900,941 A 2/1990 Barton et al.
4,901,241 A 2/1990 Schneck
4,908,770 A 3/1990 Breault et al.
4,910,686 A 3/1990 Chang et al.
4,919,325 A 4/1990 Culver
4,941,091 A 7/1990 Breault et al.
4,933,849 A 8/1990 Connell et al.
4,934,846 A 8/1990 Gilham
4,947,333 A 8/1990 Sansone et al.
4,993,752 A 2/1991 Juszak
4,998,204 A 3/1991 Sansone et al.
5,025,141 A 6/1991 Bolan
5,044,669 A 9/1991 Berry
5,058,008 A 10/1991 Schumacher
5,065,000 A 11/1991 Pusic
5,067,088 A 11/1991 Schneiderhan
5,075,862 A 12/1991 Doeberl et al.
5,077,792 A 12/1991 Herring
5,085,470 A 2/1992 Peach et al.
5,091,771 A 2/1992 Bolan et al.
5,111,030 A 5/1992 Brasington et al.
5,119,306 A 6/1992 Metelits et al.
5,136,647 A 8/1992 Haber et al.
5,150,407 A 9/1992 Chan
5,200,903 A 4/1993 Gilham et al.
5,202,834 A 4/1993 Gilham et al.
5,233,657 A 8/1993 Gunther et al.
5,237,506 A 8/1993 Horbal et al.
5,239,168 A 8/1993 Dursty, Jr. et al.
5,289,540 A 2/1994 Jones
5,316,208 A 5/1994 Petkovsek
5,319,562 A 6/1994 Whitehouse
5,323,323 A 6/1994 Gilham et al.
5,323,465 A 6/1994 Avame
5,341,505 A 8/1994 Whitehouse
5,360,628 A 11/1994 Butland
5,375,172 A 12/1994 Chrosny
5,384,886 A 1/1995 Rourke
5,388,049 A 2/1995 Sansone et al.
5,390,849 A 2/1995 Frissard
5,410,642 A 4/1995 Hakamatsuka et al.
5,423,573 A 6/1995 de Passille
5,425,586 A 6/1995 Berson
5,437,441 A 8/1995 Tuhro et al.
5,439,721 A 8/1995 Pedroli et al.
5,449,200 A 9/1995 Andric et al.
5,454,038 A 9/1995 Cordery et al.
5,471,925 A 12/1995 Heinrich et al.
5,476,420 A 12/1995 Manning
5,490,077 A 2/1996 Freytag
5,494,445 A 2/1996 Sekiguchi et al.
5,501,393 A 3/1996 Walz
5,502,304 A 3/1996 Berson et al.
5,510,992 A 4/1996 Kara
5,524,995 A 6/1996 Brookner et al.
5,554,842 A 9/1996 Connell et al.
5,569,317 A 10/1996 Sarada et al.
5,573,277 A 11/1996 Petkovsek
5,583,779 A 12/1996 Naclerio et al.
5,598,970 A 2/1997 Mudry et al.
5,600,562 A 2/1997 Guenther
5,601,313 A 2/1997 Konkol et al.
5,602,743 A 2/1997 Fraytag
5,606,507 A 2/1997 Kara
5,606,613 A 2/1997 Lee et al.
5,612,541 A 3/1997 Hoffmann et al.
5,612,889 A 3/1997 Pintsov et al.
5,615,123 A 3/1997 Davidson et al.
5,615,312 A 3/1997 Kohler
5,617,519 A 4/1997 Herbert
5,619,571 A 4/1997 Sandstrom et al.
5,623,546 A 4/1997 Hardy et al.
5,635,694 A * 6/1997 Tuhro ..... G06K 1/121
235/375
5,649,118 A 7/1997 Carlisle et al.
5,650,934 A 7/1997 Manduley
5,651,238 A 7/1997 Belec et al.
5,655,023 A 8/1997 Cordery et al.
5,666,215 A 9/1997 Fredlund et al.
5,666,284 A 9/1997 Kara
5,682,318 A 10/1997 Kara
5,696,829 A 12/1997 Cordery et al.
5,706,502 A 1/1998 Foley et al.
5,708,422 A 1/1998 Blonder et al.
5,715,314 A 2/1998 Payne et al.
5,717,595 A 2/1998 Bernard et al.
5,717,597 A 2/1998 Kara
5,717,980 A 2/1998 Oka et al.
5,729,460 A 3/1998 Plett et al.
5,737,729 A 4/1998 Denman
5,742,683 A 4/1998 Lee et al.
5,768,132 A 6/1998 Cordery et al.
5,774,886 A 6/1998 Kara
5,778,076 A 7/1998 Kara et al.
5,791,553 A 8/1998 Fabel
5,796,834 A 8/1998 Whitney et al.
5,801,364 A 9/1998 Kara et al.
5,801,944 A 9/1998 Kara
5,805,810 A 9/1998 Maxwell
5,812,991 A 9/1998 Kara
5,819,240 A 10/1998 Kara
5,822,739 A 10/1998 Kara
5,825,893 A 10/1998 Kara
5,836,617 A 11/1998 Beaudoin et al.
5,860,068 A 1/1999 Cook
5,884,277 A 3/1999 Khosla
5,902,439 A 5/1999 Pike et al.
5,923,406 A 7/1999 Brasington et al.
5,923,885 A 7/1999 Johnson et al.
5,924,738 A 7/1999 Konkol et al.
5,929,415 A 7/1999 Berson
5,932,139 A 8/1999 Oshima et al.
5,936,865 A 8/1999 Pintsov et al.

(56) References Cited

U.S. PATENT DOCUMENTS 5,936,885 A 8/1999 Morita et al.
5,946,671 A 8/1999 Herring et al.
5,950,916 A 9/1999 Santangelo
5,960,418 A 9/1999 Kelly et al.
5,983,209 A 11/1999 Kara
5,995,985 A 11/1999 Cai
6,005,945 A 12/1999 Whitehouse
6,010,069 A 1/2000 Debois
6,010,156 A 1/2000 Block
6,026,385 A 2/2000 Harvey et al.
6,033,751 A 3/2000 Kline
6,061,670 A 5/2000 Brand
D434,438 S 11/2000 Kara
6,142,380 A 11/2000 Sansone et al.
6,155,476 A 12/2000 Fabel
6,173,888 B1 1/2001 Fabel
6,175,826 B1 1/2001 Malandra, Jr. et al.
6,181,433 B1 1/2001 Hayama et al.
6,184,534 B1 2/2001 Stephany et al.
6,199,055 B1 3/2001 Kara et al.
6,208,980 B1 3/2001 Kara
6,209,779 B1 4/2001 Fabel
6,233,565 B1 5/2001 Lewis et al.
6,234,694 B1 5/2001 Brookner
6,244,763 B1 6/2001 Miller
6,249,777 B1 6/2001 Kara et al.
6,298,404 B1 10/2001 Pierce et al.
6,311,240 B1 10/2001 Boone et al.
6,322,192 B1 11/2001 Walker
6,370,844 B1 4/2002 Stricker
6,385,504 B1 5/2002 Pintsov et al.
6,397,328 B1 5/2002 Pitchenik et al.
6,415,983 B1 7/2002 Ulvr et al.
6,427,021 B1 7/2002 Fischer et al.
6,428,219 B1 8/2002 Stier et al.
6,430,543 B1 8/2002 Lee et al.
6,438,530 B1 8/2002 Heiden et al.
6,461,063 B1 10/2002 Miller et al.
6,505,179 B1 1/2003 Kara
6,505,980 B1 1/2003 Allday
6,523,014 B1 2/2003 Pauschinger
6,526,391 B1 2/2003 Cordery et al.
6,532,452 B1 3/2003 Pintsov et al.
6,594,374 B1 7/2003 Beckstrom et al.
6,595,412 B2 7/2003 Manduley
6,655,579 B1 12/2003 Delman et al.
6,671,813 B2 12/2003 Ananda
6,692,031 B2 2/2004 McGrew
6,697,822 B1 2/2004 Armatis et al.
6,701,304 B2 3/2004 Leon
6,722,563 B1 4/2004 Johnson et al.
6,735,575 B1 5/2004 Kara
6,820,201 B1 11/2004 Lincoln et al.
6,834,112 B1 12/2004 Brickell
6,834,273 B1 12/2004 Sansone et al.
6,853,990 B1 * 2/2005 Thiel ..... 705/401
6,868,406 B1 3/2005 Ogg et al.
6,902,265 B2 6/2005 Critelli et al.
6,904,188 B1 6/2005 Steinberg et al.
6,946,960 B2 9/2005 Sisson et al.
6,948,660 B2 9/2005 Critelli et al.
7,028,902 B2 4/2006 Xu et al.
7,039,214 B2 5/2006 Miller et al.
7,069,253 B2 6/2006 Leon
7,085,725 B1 8/2006 Leon
7,117,363 B2 10/2006 Lincoln et al.
7,127,434 B2 10/2006 Burningham
7,149,726 B1 12/2006 Lingle et al.
7,162,460 B2 1/2007 Cleckler et al.
7,182,259 B2 2/2007 Lubow et al.
7,191,158 B2 3/2007 Ogg
7,191,336 B2 3/2007 Zeller et al.
7,194,957 B1 3/2007 Leon et al.
7,201,305 B1 4/2007 Correa
7,222,236 B1 5/2007 Pagel
7,225,170 B1 5/2007 Ryan, Jr.
7,233,929 B1 * 6/2007 Lingle ..... G07B 17/00024 705/401
7,234,645 B2 6/2007 Silverbrook et al.
7,243,842 B1 7/2007 Leon et al.
7,266,531 B2 9/2007 Pintsov et al.
7,305,556 B2 12/2007 Slick et al.
7,337,152 B1 2/2008 Gawler
7,343,357 B1 3/2008 Kara
7,396,048 B2 7/2008 Janetzke et al.
7,418,599 B2 8/2008 Peters
7,458,612 B1 12/2008 Bennett
7,509,291 B2 3/2009 McBride et al.
7,548,612 B2 6/2009 Weissman et al.
7,577,618 B2 8/2009 Raju et al.
7,711,650 B1 5/2010 Kara
7,778,924 B1 8/2010 Ananda
7,784,090 B2 8/2010 Lord et al.
7,828,223 B1 11/2010 Leon et al.
7,831,518 B2 11/2010 Montgomery et al.
7,831,524 B2 11/2010 Whitehouse
7,831,824 B2 11/2010 Abdulhayoglu
7,840,492 B2 * 11/2010 Leung et al. ..... 705/62
7,954,709 B1 6/2011 Leon et al.
7,963,437 B1 6/2011 McBride et al.
8,100,324 B1 1/2012 Leon
8,155,976 B1 * 4/2012 Rendich et al. ..... 705/1.1
8,204,835 B1 6/2012 Ogg
8,240,579 B1 8/2012 Bennett
8,285,651 B1 10/2012 Leon et al.
8,612,361 B1 12/2013 Bussell et al.
8,626,673 B1 1/2014 Bennett
8,775,331 B1 7/2014 Tsuie et al.
9,208,620 B1 12/2015 Bortnak et al.
9,911,246 B1 3/2018 McBride et al.
9,978,185 B1 5/2018 Bortnak et al.
2001/0007086 A1 7/2001 Rogers et al.
2001/0020234 A1 9/2001 Shah et al.
2001/0022060 A1 9/2001 Robertson et al.
2001/0032881 A1 * 10/2001 Wells ..... G07B 17/00435 235/385
2001/0042052 A1 11/2001 Leon
2001/0054153 A1 12/2001 Wheeler et al.
2002/0023057 A1 2/2002 Goodwin et al.
2002/0032668 A1 3/2002 Kohler et al.
2002/0032784 A1 3/2002 Darago et al.
2002/0033598 A1 3/2002 Beasley
2002/0046195 A1 4/2002 Marlin et al.
2002/0052841 A1 5/2002 Guthrie et al.
2002/0070149 A1 6/2002 Schererz et al.
2002/0073039 A1 6/2002 Ogg et al.
2002/0073050 A1 6/2002 Gusler et al.
2002/0083020 A1 6/2002 Leon
2002/0083021 A1 6/2002 Ryan et al.
2002/1008293 6/2002 Moore et al.
2002/0099652 A1 7/2002 Herzen et al.
2002/0143431 A1 10/2002 Sansone
2002/0149195 A1 10/2002 Beasley
2002/0190117 A1 12/2002 Manduley
2003/0002709 A1 1/2003 Wu
2003/0029914 A1 2/2003 Hortman et al.
2003/0030270 A1 2/2003 Franko et al.
2003/0037008 A1 2/2003 Raju et al.
2003/0059635 A1 3/2003 Naasani
2003/0078893 A1 4/2003 Shah et al.
2003/0080182 A1 5/2003 Gunther
2003/0088426 A1 5/2003 Benson et al.
2003/0101143 A1 5/2003 Montgomery et al.
2003/0101147 A1 5/2003 Montgomery et al.
2003/0101148 A1 5/2003 Montgomery et al.
2003/0115162 A1 6/2003 Konick
2003/0138345 A1 7/2003 Schwabe
2003/0140017 A1 7/2003 Patton et al.
2003/0144972 A1 7/2003 Cordery et al.
2003/0167241 A1 9/2003 Gilham
2003/0182155 A1 9/2003 Nitzan et al.
2003/0187666 A1 10/2003 Leon
2003/0204477 A1 10/2003 McNett
2003/0236709 A1 12/2003 Hendra et al.

(56) References Cited

U.S. PATENT DOCUMENTS

| | | | | |
|---|---|---|---|---|
| 2003/1023327 | | 12/2003 | Pearlman et al. | |
| 2004/0000787 | A1 | 1/2004 | Vig et al. | |
| 2004/0002926 | A1 | 1/2004 | Coffy et al. | |
| 2004/0048503 | A1 | 3/2004 | Mills et al. | |
| 2004/0064422 | A1 | 4/2004 | Leon | |
| 2004/0070194 | A1 | 4/2004 | Janetzke et al. | |
| 2004/0083179 | A1 | 4/2004 | Sesek et al. | |
| 2004/0089482 | A1 | 5/2004 | Ramsden et al. | |
| 2004/0112950 | A1 | 6/2004 | Manduley et al. | |
| 2004/0122776 | A1 | 6/2004 | Sansone | |
| 2004/0122779 | A1 | 6/2004 | Stickler et al. | |
| 2004/0125413 | A1 | 7/2004 | Cordery | |
| 2004/0128264 | A1* | 7/2004 | Leung et al. | 705/402 |
| 2004/0174012 | A1 | 9/2004 | Hagen | |
| 2004/0185827 | A1 | 9/2004 | Parks | |
| 2004/0185882 | A1 | 9/2004 | Gecht et al. | |
| 2004/0186811 | A1 | 9/2004 | Gullo et al. | |
| 2004/0200902 | A1 | 10/2004 | Ishioroshi | |
| 2004/0215523 | A1 | 10/2004 | Wulff et al. | |
| 2004/0215581 | A1 | 10/2004 | Lord et al. | |
| 2004/0215583 | A1 | 10/2004 | Elliott | |
| 2004/0220935 | A1 | 11/2004 | McGraw et al. | |
| 2004/0236938 | A1 | 11/2004 | Callaghan | |
| 2004/0241424 | A1 | 12/2004 | Barbera-Guillem | |
| 2004/0254898 | A1 | 12/2004 | Parker et al. | |
| 2005/0033653 | A1 | 2/2005 | Eisenberg et al. | |
| 2005/0065892 | A1 | 3/2005 | Ryan et al. | |
| 2005/0065896 | A1 | 3/2005 | Kummer et al. | |
| 2005/0065897 | A1 | 3/2005 | Ryan et al. | |
| 2005/0071296 | A1 | 3/2005 | Lepkofker | |
| 2005/0071297 | A1 | 3/2005 | Kara | |
| 2005/0080751 | A1 | 4/2005 | Burningham | |
| 2005/0082818 | A1 | 4/2005 | Mertens | |
| 2005/0087605 | A1 | 4/2005 | Auslander et al. | |
| 2005/0114276 | A1 | 5/2005 | Hunter et al. | |
| 2005/0116047 | A1 | 6/2005 | Lu et al. | |
| 2005/0137949 | A1 | 6/2005 | Rittman et al. | |
| 2005/0171869 | A1* | 8/2005 | Minnocci | 705/28 |
| 2005/0192899 | A1 | 9/2005 | Reardon | |
| 2005/0192911 | A1* | 9/2005 | Mattern | 705/401 |
| 2005/0195214 | A1 | 9/2005 | Reid et al. | |
| 2005/0209913 | A1 | 9/2005 | Wied et al. | |
| 2005/0237203 | A1 | 10/2005 | Burman et al. | |
| 2005/0256811 | A1 | 11/2005 | Pagel et al. | |
| 2005/0278263 | A1 | 12/2005 | Hollander et al. | |
| 2005/0278266 | A1 | 12/2005 | Ogg et al. | |
| 2006/0000648 | A1 | 1/2006 | Galtier | |
| 2006/0020505 | A1 | 1/2006 | Whitehouse | |
| 2006/0116971 | A1 | 6/2006 | Beckstrom et al. | |
| 2006/0118631 | A1 | 6/2006 | Lubow et al. | |
| 2006/0122947 | A1 | 6/2006 | Poulin | |
| 2006/0136347 | A1 | 6/2006 | Reichelsheimer et al. | |
| 2006/0173796 | A1* | 8/2006 | Kara | 705/401 |
| 2006/0190418 | A1* | 8/2006 | Huberty | G07B 17/00024 705/402 |
| 2006/0220298 | A1 | 10/2006 | Fairweather et al. | |
| 2006/0238334 | A1 | 10/2006 | Mangan et al. | |
| 2006/0259390 | A1 | 11/2006 | Rosenberger | |
| 2006/0283943 | A1 | 12/2006 | Ostrowski et al. | |
| 2006/0287096 | A1 | 12/2006 | O'Kelley, II et al. | |
| 2006/0293907 | A1 | 12/2006 | Castineiras | |
| 2007/0005518 | A1 | 1/2007 | Beckstrom et al. | |
| 2007/0011995 | A1 | 1/2007 | Weaver et al. | |
| 2007/0017985 | A1 | 1/2007 | Lapstun et al. | |
| 2007/0033110 | A1 | 2/2007 | Philipp et al. | |
| 2007/0073587 | A1 | 3/2007 | Walker et al. | |
| 2007/0078795 | A1* | 4/2007 | Chatte | 705/403 |
| 2007/0080228 | A1 | 4/2007 | Knowles et al. | |
| 2007/0100572 | A1 | 5/2007 | McBride et al. | |
| 2007/0174215 | A1 | 7/2007 | Morel | |
| 2007/0179853 | A1 | 8/2007 | Feige et al. | |
| 2007/0185726 | A1 | 8/2007 | Stickler et al. | |
| 2007/0198441 | A1 | 8/2007 | Kara | |
| 2007/0253350 | A1 | 11/2007 | Tung et al. | |
| 2007/0255664 | A1 | 11/2007 | Blumberg et al. | |
| 2008/0046384 | A1* | 2/2008 | Braun et al. | 705/401 |
| 2009/0125561 | A1 | 5/2009 | Garcia | |
| 2009/0164392 | A1 | 6/2009 | Raju et al. | |
| 2009/0171861 | A1* | 7/2009 | Horree | G07B 17/00362 705/410 |
| 2009/0212098 | A1 | 8/2009 | Stratton et al. | |
| 2010/0298662 | A1 | 11/2010 | Yu et al. | |
| 2010/0312627 | A1 | 12/2010 | Khechef et al. | |
| 2011/0015935 | A1 | 1/2011 | Montgomery et al. | |
| 2011/0022544 | A1 | 1/2011 | Kim et al. | |
| 2011/0029429 | A1 | 2/2011 | Whitehouse | |
| 2011/0071944 | A1 | 3/2011 | Heiden et al. | |
| 2011/0145107 | A1 | 6/2011 | Greco | |
| 2011/0204132 | A1 | 8/2011 | Vera | |
| 2011/0225180 | A1 | 9/2011 | Liao et al. | |
| 2012/0008766 | A1 | 1/2012 | Robertson et al. | |
| 2012/0159603 | A1 | 6/2012 | Queck | |
| 2012/0233252 | A1 | 9/2012 | Vats et al. | |
| 2012/0240204 | A1 | 9/2012 | Bhatnagar et al. | |

FOREIGN PATENT DOCUMENTS

| | | | |
|---|---|---|---|
| EP | 153816 | A2 | 9/1985 |
| EP | 0282359 | A2 | 9/1988 |
| EP | 0507562 | A2 | 10/1992 |
| EP | 0571259 | A1 | 11/1993 |
| EP | 0596706 | A1 | 5/1994 |
| EP | 0658861 | A1 | 6/1995 |
| EP | 0782111 | | 7/1997 |
| EP | 0900830 | A1 | 3/1999 |
| EP | 0927958 | A2 | 7/1999 |
| EP | 0927963 | A2 | 7/1999 |
| EP | 1098429 | A2 | 5/2001 |
| EP | 1525994 | A2 | 4/2005 |
| FR | 2580844 | A1 | 10/1986 |
| GB | 2246929 | A | 2/1992 |
| GB | 2251210 | A | 7/1992 |
| GB | 2271452 | A | 4/1994 |
| JP | 63147673 | | 6/1988 |
| JP | 04284558 | B2 | 10/1992 |
| JP | 05-132049 | | 5/1993 |
| JP | 09-508220 | | 8/1997 |
| JP | 11-249205 | | 9/1999 |
| JP | 2000-105845 | A | 4/2000 |
| JP | 2005-215905 | A | 8/2005 |
| WO | WO-88/01818 | A1 | 3/1988 |
| WO | WO-94/27258 | A1 | 11/1994 |
| WO | WO-1995/19016 | A1 | 7/1995 |
| WO | WO-95/17732 | | 8/1995 |
| WO | WO-97/14085 | | 4/1997 |
| WO | WO-9740472 | | 10/1997 |
| WO | WO-98/14907 | A2 | 4/1998 |
| WO | WO-98/14909 | | 4/1998 |
| WO | WO-98/57302 | A1 | 12/1998 |
| WO | WO-98/57460 | A1 | 12/1998 |
| WO | WO-02063517 | A2 | 8/2002 |
| WO | WO-03/039051 | A2 | 5/2003 |
| WO | WO-03/083784 | | 9/2003 |
| WO | WO-2005/042645 | A2 | 5/2005 |
| WO | WO-2005/060590 | A2 | 7/2005 |

OTHER PUBLICATIONS

Martorelli, Business Reply Mail, Winton M. Blount Postal History Symposium, Sep. 2011.*

U.S. Appl. No. 10/862,058, Pagel et al.

U.S. Appl. No. 11/509,309, J. P. Leon.

U.S. Appl. No. 11/729,148, Leon et al.

U.S. Appl. No. 12/030,739, McBride et al.

U.S. Appl. No. 11/616,546, Bussell et al.

Ford, Colleen, "Frequent Flyer Programs," Australian Accountant, 63,1, Feb. 1993, pp. 52-58.

Alexander, Keith L., "U.S. Stamps Pay Tribute to Starry-Eyed Jurors", Final Edition, Calgary Herald, Calgary, Alberta, Canada, Sep. 14, 2007, 2 pgs.

Office Action issued for U.S. Appl. No. 11/353,690 dated Aug. 3, 2009, 19 pgs.

(56) References Cited

OTHER PUBLICATIONS

U.S. Appl. No. 11/616,569, Tsuie et al.
U.S. Appl. No. 12/103,496, Bortnak et al.
U.S. Appl. No. 12/553,824, Bortnak et al.
U.S. Appl. No. 12/316,240.
"Mobile Postage stamps via text message announced", http://telecoms.cytalk.com/2011/03/mobile-postage-stamps-via-text-messages-announced/, CY.TALK Telecoms News Blog, Mar. 14, 2011 in Telecoms, Texting, pp. 1-9.
Mobile Postage Stamps via Text Messages Announced, Phone Reviews, Mobile Phones, News, Mar. 11, 2011, pp. 1-3.
Anonymous, "Automated Indicia Detection System From Parascript Protects Postage Revenue for Postal Operators, Cracks Down on Fraud—Parascript StampVerify Simplifies Complex Task of Automatically Locating and Verifying Different Types of Indicia on Envelope Images." PR Newswire, New York, Sep. 18, 2007.
Feare, Tom, "Shipping System Saves $2 Million Yearly," Modem Materials Handling, Aug. 2000, 55, 9; pp. A6-A7.
Brown, B., "Internet Postage Services," PC Magazine, Jun. 6, 2000, p. 133, Ziff-Davis Publishing Company, 1 page.
"Zazzle® Offers Zazzle Custom Stamps™ for Business," May 17, 2006, https:--www.zazzle.com-about-press-releases?pr=12624, 2 pages.
Porter, W., "Canadians Take to Vanity Stamps in Very Big Way," Denver Post, Jul. 9, 2000, 2 pages.
Derrick, J. "The Meter is Running," Office Systems, vol. 11 No. 9, Sep. 1994, 6 pages.
Computergram International, "U.S. Postal Service to Introduce PC Postage Plans Today," Aug. 9, 1999, No. 3720, 1 page.
Terrell, "Licking Stamps: A PC and a Printer Will End Trips to the Post Office," U.S. News & World Report, Sep. 28, 1998, vol. 125, No. 12, 4 pages.
"Miniature, Coin-Shaped Chip is Read or Written with a Touch," News Release, Dallas Semiconductor, Jul. 1991, 9 pages.
"Endicia Announces PictureItPostage™," Jun. 6, 2005, http:--www.endicia.com---media-Files-About%20Us-Press%20Room-Endicia_pr05-06-06.ashx>, 2 pages.
Ralph, J. "What's Selling: From Bricks and Mortar to Bricks and Clicks," Playthings Magazine, Feb. 1, 2003, 4 pages.
Menezes, A.J. et al., "Handbook of Applied Cryptography," CRC Press LLC, 1997 (Excerpt—Cover pages and pp. 512-515), 22 pages.
"Information-Based Indicia Program (IBIP) Performance Criteria for Information-Based Indicia and Security Architecture for Closed IBI Postage Metering Systems (PCIBI-C)," Jan. 12, 1999, The United States Postal Service (USPS), 49 pages.
Stamps: Beyond Elvis, May 15, 1994, New York Times Archives, 2 pages.
Minnick, R., "Postage Imprinting Apparatus and Methods for Use With a Computer Printer," Apr. 27, 1995, 71 pages.
Office Action dated Mar. 13, 2007 for JP 515,253-97; with English language translation (4 pages).
Office Action issued for Japanese Patent Application No. 515,253-1997, dated Apr. 21, 2009; 5 pages (with English language translation).
Appeal Decision dated Apr. 20, 2010 for U.S. Appl. No. 10/991,241 to Kara, filed Nov. 17, 2004, and entitled "System and Method for Generating Personalized Postage Indicia," 9 pages.
Examiner's Answer to Appeal Brief dated Feb. 19, 2009 for U.S. Appl. No. 10/991,241 to Kara, filed Nov. 17, 2004, and entitled "System and Method for Generating Personalized Postage Indicia," 14 pages.
Final Office Action dated Dec. 10, 2008 for U.S. Appl. No. 10/994,914 to McBride et al., filed Nov. 22, 2004, and entitled "Customized Computer-Based Value-Bearing Item Quality Assurance," 25 pages.
Final Office Action dated Dec. 4, 2009 for U.S. Appl. No. 11/644,458 to Leon, filed Dec. 20, 2006, and entitled "Systems and Methods for Creating and Providing Shape-Customized, Computer-Based, Value-Bearing Items," 17 pages.
Final Office Action dated Jan. 26, 2009 for U.S. Appl. No. 10/994,728 to Huebner et al., filed Nov. 22, 2004, and entitled "Printing of Computer-Based Value-Bearing Items," 13 pages.
Final Office Action dated Jan. 31, 2008 for U.S. Appl. No. 10/991,241 to Kara, filed Nov. 17, 2004, and entitled "System and Method for Generating Personalized Postage Indicia," 13 pages.
Final Office Action dated Jun. 23, 2009 for U.S. Appl. No. 11/114,984 to Clem et al., filed Apr. 25, 2005, and entitled "Quality Assurance of Image-Customization of Computer-Based Value-Bearing Items," 11 pages.
Final Office Action dated Jun. 30, 2010 for U.S. Appl. No. 11/114,984 to Clem et al., filed Apr. 25, 2005, and entitled "Quality Assurance of Image-Customization of Computer-Based Value-Bearing Items," 23 pages.
Final Office Action dated Mar. 15, 2010 for U.S. Appl. No. 10/994,914 to McBride et al., filed Nov. 22, 2004, and entitled "Customized Computer-Based Value-Bearing Item Quality Assurance," 31 pages.
Final Office Action dated Apr. 21, 2010 for U.S. Appl. No. 11/435,453 to Clem, filed May 16, 2006, and entitled "Rolls of Image-Customized Value-Bearing Items and Systems and Methods for Providing Rolls of Image-Customized Value-Bearing Items," 12 pages.
Final Office Action dated Mar. 16, 2010 for U.S. Appl. No. 10/994,728 to Huebner et al., filed Nov. 22, 2004, and entitled "Printing of Computer-Based Value-Bearing Items," 13 pages.
Final Office Action dated Mar. 4, 2009 for U.S. Appl. No. 10/994,698 to Leon et al., filed Nov. 22, 2004, and entitled "Image Customization of Computer-Based Value-Bearing Items," 12 pages.
Final Office Action dated May 11, 2010 for U.S. Appl. No. 10/994,698 to Leon et al., filed Nov. 22, 2004, and entitled "Image Customization of Computer-Based Value-Bearing Items," 18 pages.
Final Office Action dated Nov. 4, 2010 for U.S. Appl. No. 11/844,458 to Leon, filed Dec. 20, 2006, and entitled "Systems and Methods for Creating and Providing Shape-Customized, Computer-Based, Value-Bearing Items," 22 pages.
Interview Summary dated Sep. 2, 2010 for U.S. Appl. No. 11/644,458 to Leon, filed Dec. 20, 2006, and entitled "Systems and Methods for Creating and Providing Shape-Customized, Computer-Based, Value-Bearing Items," 4 pages.
Non-Final Office Action dated Apr. 16, 2009 for U.S. Appl. No. 11/644,458 to Leon, filed Dec. 20, 2006, and entitled "Systems and Methods for Creating and Providing Shape-Customized, Computer-Based, Value-Bearing Items," 15 pages.
Non-Final Office Action dated Apr. 17, 2008 for U.S. Appl. No. 10/994,914 to McBride et al., filed Nov. 22, 2004, and entitled "Customized Computer-Based Value-Bearing Item Quality Assurance," 19 pages.
Non-Final Office Action dated Aug. 11, 2009 for U.S. Appl. No. 11/435,453 to Clem., filed May 16, 2006, and entitled "Rolls of Image-Customized Value-Bearing Items and Systems and Methods for Providing Rolls of Image-Customized Value-Bearing Items." 9 pages.
Non-Final Office Action dated Aug. 19, 2008 for U.S. Appl. No. 10/994,698 to Leon et al., filed Nov. 22, 2004, and entitled "Image Customization of Computer-Based Value-Bearing Items," 16 pages.
Non-Final Office Action dated Aug. 19, 2009 for U.S. Appl. No. 10/994,728 to Huebner et al., filed Nov. 22, 2004, and entitled "Printing of Computer-Based Value-Bearing Items," 13 pages.
Non-Final Office Action dated Aug. 26, 2009 for U.S. Appl. No. 10/994,914 to McBride et al., filed Nov. 22, 2004, and entitled "Customized Computer-Based Value-Bearing Item Quality Assurance," 29 pages.
Non-Final Office Action dated Aug. 3, 2009 for U.S. Appl. No. 10/994,698 to Leon et al., filed Nov. 22, 2004, and entitled "Image Customization of Computer-Based Value-Bearing Items," 13 pages.
Non-Final Office Action dated Dec. 12, 2007 for U.S. Appl. No. 11/635,871 to McBride et al., filed Dec. 8, 2006, and entitled "Formatting Value-Bearing Item Indicia," 5 pages.
Non-Final Office Action dated Dec. 23, 2009 for U.S. Appl. No. 11/114,964 to Clem et al., filed Apr. 25, 2005, and entitled "Quality Assurance of Image-Customization of Computer-Based Value-Bearing Items," 21 pages.

(56) References Cited

OTHER PUBLICATIONS

Non-Final Office Action dated Dec. 31, 2007 for U.S. Appl. No. 10/991,241 to Kara, filed Nov. 17, 2004, and entitled "System and Method for Generating Personalized Postage Indicia," 11 pages.
Non-Final Office Action dated Dec. 9, 2009 for U.S. Appl. No. 11/729,239 to Leon et al., filed Mar. 28, 2007, and entitled "Computer-Based Value-Bearing Item Customization Security," 6 pages.
Non-Final Office Action dated Jul. 12, 2007 for U.S. Appl. No. 10/991,241 to Kara, filed Nov. 17, 2004, and entitled "System and Method for Generating Personalized Postage Indicia," 11 pages.
Non-Final Office Action dated Jul. 19, 2005 for U.S. Appl. No. 10/991,241 to Kara, filed Nov. 17, 2004, and entitled "System and Method for Generating Personalized Postage Indicia," 9 pages.
Non-Final Office Action dated Jul. 21, 2010 for U.S. Appl. No. 10/994,914 to McBride et al., filed Nov. 22, 2004, and entitled "Customized Computer-Based Value-Bearing Item Quality Assurance," 33 pages.
Non-Final Office Action dated Jul. 7, 2008 for U.S. Appl. No. 10/991,241 to Kara, filed Nov. 17, 2004, and entitled "System and Method for Generating Personalized Postage Indicia," 12 pages.
Non-Final Office Action dated Feb. 23, 2011 for U.S. Appl. No. 12/943,519 to Clem, filed Nov. 10, 2010, and entitled "Rolls of Image-Customized Value-Bearing Items and Systems and Methods for Providing Rolls of Image-Customized Value-Bearing Items," 8 pages.
Non-Final Office Action dated Jun. 19, 2007 for U.S. Appl. No. 11/635,871 to McBride et al., filed Dec. 8, 2006, and entitled "Formatting Value-Bearing Item Indicia," 5 pages.
Non-Final Office Action dated May 29, 2008 for U.S. Appl. No. 10/994,728 to Huebner et al., filed Nov. 22, 2004, and entitled "Printing of Computer-Based Value-Bearing Items," 11 pages.
Non-Final Office Action dated May 7, 2010 for U.S. Appl. No. 11/644,458 to Leon, filed Dec. 20, 2006, and entitled "Systems and Methods for Creating and Providing Shape-Customized, Computer-Based, Value-Bearing Items," 18 pages.
Non-Final Office Action dated Nov. 26, 2008 for U.S. Appl. No. 11/114,964 to Clem et al., filed Apr. 25, 2005, and entitled "Quality Assurance of Image-Customization of Computer-Based Value-Bearing Items," 9 pages.
Non-Final Office Action dated Oct. 31, 2006 for U.S. Appl. No. 10/991,241 to Kara, filed Nov. 17, 2004, and entitled "System and Method for Generating Personalized Postage Indicia," 11 pages.
Notice of Abandonment dated Jun. 30, 2010 for U.S. Appl. No. 10/991,241 to Kara, filed Nov. 17, 2004, and entitled "System and Method for Generating Personalized Postage Indicia," 2 pages.
Notice of Allowance dated Aug. 5, 2010 for U.S. Appl. No. 11/435,453 to Clem, filed May 16, 2006, and entitled "Rolls of Image-Customized Value-Bearing Items and Systems and Methods for Providing Rolls of Image-Customized Value-Bearing Items." 11 pages.
Notice of Allowance dated Dec. 2, 2010 for U.S. Appl. No. 10/994,698 to Leon et al., filed Nov. 22, 2004, and entitled "Image Customization of Computer-Based Value-Bearing Items," 5 pages.
Notice of Allowance dated Feb. 3, 2011 for U.S. Appl. No. 11/114,964 to Clem et al., filed Apr. 25, 2005, and entitled "Quality Assurance of Image-Customization of Computer-Based Value-Bearing Items," 7 pages.
Notice of Allowance dated Jan. 5, 2007 for U.S. Appl. No. 10/994,768 to Leon et al., filed Nov. 22, 2004, and entitled "Computer-Based Value-Bearing Item Customization Security," 7 pages.
Notice of Allowance dated Jul. 15, 2008 for U.S. Appl. No. 11/635,871 to McBride et al., filed Dec. 8, 2006, and entitled "Formatting Value-Bearing Item Indicia," 7 pages.
Notice of Allowance dated Jun. 24, 2010 for U.S. Appl. No. 11/729,239 to Leon et al., filed Mar. 28, 2007, and entitled "Computer-Based Value-Bearing Item Customization Security," 6 pages.
Notice of Allowance dated Nov. 17, 2008 for U.S. Appl. No. 11/635,871 to McBride et al., filed Dec. 8, 2006, and entitled "Formatting Value-Bearing Item Indicia," 7 pages.
Notice of Allowance dated Nov. 24, 2008 for U.S. Appl. No. 10/197,044 to Raju et al., filed Jul. 16, 2002, and entitled "Generic Value Bearing Item Labels," 7 pages.
U.S. Appl. No. 10/994,698 to Leon et al., filed Nov. 22, 2004, and entitled "Image Customization of Computer-Based Value-Bearing Items," 126 pages.
U.S. Appl. No. 10/994,728 to Huebner et al., filed Nov. 22, 2004, and entitled "Printing of Computer-Based Value-Bearing Items," 122 pages.
U.S. Appl. No. 10/994,914 to McBride et al., filed Nov. 22, 2004, and entitled "Customized Computer-Based Value-Bearing Item Quality Assurance," 131 pages.
U.S. Appl. No. 11/114,964 to Clem et al., filed Apr. 25, 2005, and entitled "Quality Assurance of Image-Customization of Computer-Based Value-Bearing Items," 122 pages.
U.S. Appl. No. 11/435,453 to Clem, filed May 16, 2006, and entitled "Rolls of Image-Customized Value-Bearing Items and Systems and Methods for Providing Rolls of Image-Customized Value-Bearing Items," 69 pages.
U.S. Appl. No. 11/644,458 to Leon, filed Dec. 20, 2006, and entitled "Systems and Methods for Creating and Providing Shape-Customized, Computer-Based, Value-Bearing Items," 77 pages.
U.S. Appl. No. 11/729,239 to Leon et al., filed Mar. 28, 2007 and entitled "Computer-Based Value-Bearing Item Customization Security," 131 pages.
U.S. Appl. No. 12/316,240 to Leon, filed Dec. 9, 2008, and entitled "Systems and Methods for Facilitating Replacement of Computer-Based Value-Bearing Items," 158 pages.
U.S. Appl. No. 12/500,970 to Clem, filed Jul. 10, 2009, and entitled "Automatic Guarantee Delivery Tracking and Reporting for United States Postal Service Postage Refunds for Paid Computer-Based Postage," 70 pages.
U.S. Appl. No. 12/943,519 to Clem, filed Nov. 10, 2010, and entitled "Rolls of Image-Customized Value-Bearing Items and Systems and Methods for Providing Rolls of Image-Customized Value-Bearing Items," 65 pages.
U.S. Appl. No. 13/038,029 to Leon et al, filed Mar. 1, 2011 and entitled "Image-Customization of Computer-Based Value-Bearing Items," 131 pages.
U.S. Appl. No. 13/081,356 to Leon et al, filed Apr. 6, 2011 and entitled "Computer-Based Value-Bearing Item Customization Security," 136 pages.
Unpublished U.S. Appl. No. 11/509,309 to Leon filed Aug. 24, 2006 and entitled "Invisible Fluorescent Ink Mark," 15 pages.
International Search Report attached to PCT Application WO-88/01818, dated Nov. 30, 1987, 2 pages.
International Search Report issued for Application PCT/US96/16366, dated Jun. 13, 1997, 9 pages.
Unpublished U.S. Appl. No. 11/323,483 to Leon et al., filed Dec. 30, 2005 and entitled "Systems and Methods for Single Pass Printing Postage Indicia," 23 pages.
Davies, Brad L. "Printing System for Preventing Injustice by Delivering Print Data from Postal Charge Meter to Printer," Jan. 2001 1 page.
Unpublished U.S. Appl. No. 13/172,066 to McBride et al., filed Jun. 29, 2011 and entitled "Systems and Methods Using Mobile Communication Handsets for Providing Postage," 50 pages.
Unpublished U.S. Appl. No. 13/286,854 to Crouse et al., filed Nov. 1, 2011 and entitled "Perpetual Value Bearing Shipping Labels," 49 pages.

* cited by examiner

SYSTEMS AND METHODS FOR DISTRIBUTED ACTIVATION OF POSTAGE

RELATED APPLICATIONS

The present application is related to and commonly assigned U.S. patent application Ser. No. 10/862,058 entitled "Virtual Security Device," filed Jun. 4, 2004, Ser. No. 11/509,309 entitled "Invisible Fluorescent Ink Mark," filed Aug. 24, 2006, and Ser. No. 11/729,148 entitled "Computer-Based Value-Bearing Item Customization Security," filed Mar. 27, 2007 the disclosures of which are hereby incorporated herein by reference.

TECHNICAL FIELD

The invention relates generally to postage and, more particularly, to providing distributed activation of postage.

BACKGROUND OF THE INVENTION

The ability to meter postage indicia for printing postage meter stamps at user's locations, such as home and office, has been available for an appreciable amount of time. For example, postage meters using mechanical postage value "vaults" have been widely used in businesses throughout the world for printing postage indicia, commonly referred to as postage meter stamps, on an as-needed basis. In more recent years, electronic systems were developed using electronic postage value vaults to provide improved security. The evolution of such electronic systems has ultimately led to the development of postage metering systems which allow remote metering operations using communications via the public switched telephone network (PSTN), local area networks (LANs), wide area networks (WANs), and the Internet. For example, U.S. Pat. No. 6,249,777 entitled "System and Method for Remote Postage Metering," U.S. Pat. No. 6,671,813 entitled "Secure On-Line PC Postage Metering System," and U.S. Pat. No. 7,149,726 entitled "Online Value Bearing Item Printing," the disclosures of which are incorporated herein by reference, show various electronic value bearing indicia (VBI) metering systems facilitating remote metering operations.

Each of the foregoing postage metering systems have implemented some form of printing apparatus in order to provide convenient printing of postage meter stamps on demand. Such postage meter stamp printing operations have typically implemented specialized printing technologies. Accordingly, the print mechanisms and attendant systems are often quite expensive, complicated, slow, and inconvenient.

For example, controlled inks, such as fluorescent inks of special color, have been required with respect to printing mechanisms providing mechanical impression of postage meter stamps. The use of such inks is often inconvenient for the users and can be quite messy. Moreover, the printing mechanisms must typically be relatively complex in order to accommodate various sizes, shapes, and thicknesses of mail items.

Electronic postage metering systems have more recently begun using information based indicia (IBI) which may be printed using commonly available inks and toners. However, users must typically provide at least some information for each mail item in order for validation to later be performed with respect to IBI based postage meter stamps. Moreover, generating the IBI, typically including cryptographic signatures and other data, generally requires appreciable time.

The symbology used in IBI based postage meter stamps (e.g., PDF417 barcode) is relatively complicated and dense, generally requiring a high quality print image. Accordingly, relatively expensive and/or complex printing equipment is often needed to provide sufficient quality printing.

Application on uneven or non-uniform surfaces, such as may be associated with a stuffed envelope or other mail item, is problematic with respect to mechanical postage meter stamp impressions and printed image postage meter stamps alike. Application upon such surfaces can result in distortion, incomplete printing, and the like, rendering the postage meter stamp unusable or otherwise unacceptable. Accordingly, the foregoing postage metering systems are often unable to accommodate some mailing scenarios.

BRIEF SUMMARY OF THE INVENTION

The present invention is directed to systems and methods which provide for distributed activation of pre-printed, or otherwise pre-produced, indicia to thereby provide value bearing indicia, such as postage indicia. Embodiments of the invention apply indicia to fungible items, such as envelopes, paper stock, labels, etc., at a central location. The items may then be provided to a number of users for their use in posting mail items. When one of the items bearing the pre-produced indicia is incorporated into a mail item by a user, the pre-produced indicia is preferably activated and thus becomes valid postage indicia for use in posting the mail item.

According to an embodiment of the invention, indicia are pre-produced to include unique, relatively unique, or substantially unique codes (collectively referred to herein as unique codes). Relatively unique or substantially unique codes as used herein provide codes which, although they may not be truly unique in the relevant universe, are sufficiently unique to provide identification of indicia to a high degree of confidence so as to serve the purposes described herein. The pre-produced indicia preferably comprise a machine readable symbology, such as barcode, although other forms of symbology, such as human readable characters, may be used in addition to or in the alternative to machine readable symbologies. Unique codes included in the pre-produced indicia may include serial or sequence numbers, identification information, digital signatures, cryptographic keys, and/or the like useful in uniquely identifying the pre-produced indicia and/or postage indicia represented thereby.

Pre-produced indicia may be printed using media which is visible in natural light or which is invisible in natural light according to embodiments of the invention. For example, in order to provide envelope stock which appears similar to blank stock, pre-produced indicia of an embodiment of the invention may be printed using an ink which is invisible in natural light. Printed matter using such ink may be viewed using light of an appropriate wavelength, such as light in the ultraviolet spectrum. Visibility of the pre-produced indicia may be transient (e.g., visible only when light of the appropriate wavelength is present) or more permanent (e.g., chemically or molecularly changing to remain visible after light of the appropriate wavelength to "develop" the image is removed).

Various images, information, characters, symbols, and/or marks (collectively referred to as marks) may be provided in association with pre-produced indicia of embodiments of the invention. Such marks may include marks used in preparing mail items (e.g., registration or orientation mark used to facilitate activation of the pre-produced indicia, text providing information with respect to the pre-produced indicia, marks to show when a pre-produced indicia has/has not been activated, human readable version of a unique code, etc.), marks used in processing mail items (e.g., a facing identification mark (FIM), text providing information with respect to a class of mail, text providing information with respect to a service to be provided, human readable version of a unique code, address information, etc.), marks for aesthetic or other purposes (e.g., an image representing a traditional postage stamp, advertising message, business logo, etc.), and/or the like.

The foregoing marks may be printed using media which is visible in natural light or which is invisible in natural light. Such marks may be printed using a same or different media than an accompanying pre-produced indicia. For example, a registration or orientation mark used to facilitate activation of the pre-produced indicia may be printed using an ink which is visible in natural light when the pre-produced indicia is printed in an ink which is not visible in natural light for use in assisting a user properly orienting the stock (e.g., envelope) for scanning the pre-produced indicia for activation, for printing information such as addresses on the stock, etc. A mark used to show when the pre-produced indicia has been activated may be printed in an ink which is not visible in natural light, but which is made visible in natural light upon activation of the pre-produced indicia.

Embodiments of the invention implement a system for scanning pre-produced indicia for activation as postage indicia. For example, a scanner may be disposed at a user's location for scanning a pre-produced indicia on a selected piece of stock (e.g., envelope). A unique code included in the pre-produced indicia may thus be obtained and used to activate the pre-produced indicia and/or account for postage value (e.g., charge a user's account for the appropriate postage value). For example, a user terminal may transmit the unique code to one or more postal servers in order to debit an account for an appropriate amount of postage (or otherwise account for postage value) and to cause the pre-produced indicia to be entered into a database of valid postage indicia. The scanned indicia may comprise a simplified indicia, such as a one dimensional barcode or "light" version of pre-produced indicia (e.g., including only partial indicia information, such as shown and described in the above referenced patent application entitled "Computer-Based Value-Bearing Item Customization Security"), used to identify a more complex or complete version of indicia, such as a corresponding two dimensional barcode or other data packet (e.g., as may be stored at a validation system and/or as may be present on the pre-produced stock).

Human readable information, such as a serial number or alphanumeric code, may be utilized according to embodiments of the invention where automated scanning is not available or is not desired. For example, a user may directly input a human readable unique code included in the pre-produced indicia into a user terminal for transmission to one or more postal servers in order to debit an account for an appropriate amount of postage (or otherwise account for postage value) and to cause the pre-produced indicia to be entered into a database of valid postage indicia.

Information in addition to the aforementioned unique code may be utilized according to this embodiment of the invention for activation of the pre-produced indicia. For example, information with respect to the postal item weight, size, class, delivery service selected, address information, etc. may be utilized in determining an appropriate amount of postage value, to dispatch a courier to retrieve the mail item, to predict postal processing resource utilization, etc.

An audit procedure is preferably implemented with respect to postal processing in order to identify attempted use of pre-produced indicia which have not been properly activated. Upon detection of a non-activated pre-produced indicia in the mail stream, systems of the present invention may cause the mail item to be refused by a postal authority. Alternatively, systems of the present invention may operate to activate the pre-produced indicia, such as where an account can be identified for providing an appropriate amount of postal value.

Postage indicia provided according to embodiments of the present invention may be of predetermined value (e.g., value determined at the time of printing the pre-produced indicia) or of selectable value (e.g., value determined at the time of activating the pre-produced indicia). Additionally, postage indicia provided according to embodiments of the invention may be anonymous (e.g., a user of the indicia is not identified by the indicia, as with a traditional postage stamp) or onymous (e.g., identifying a user or an account associated with the use of the indicia). Postage indicia provided according to embodiments of the invention may be geographically ambivalent (e.g., having no limitation with respect to a source or destination address associated with use of the postage indicia) or geographically restricted (e.g., having a limitation with respect to a source and/or destination address associated with the use of the postage indicia).

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1:
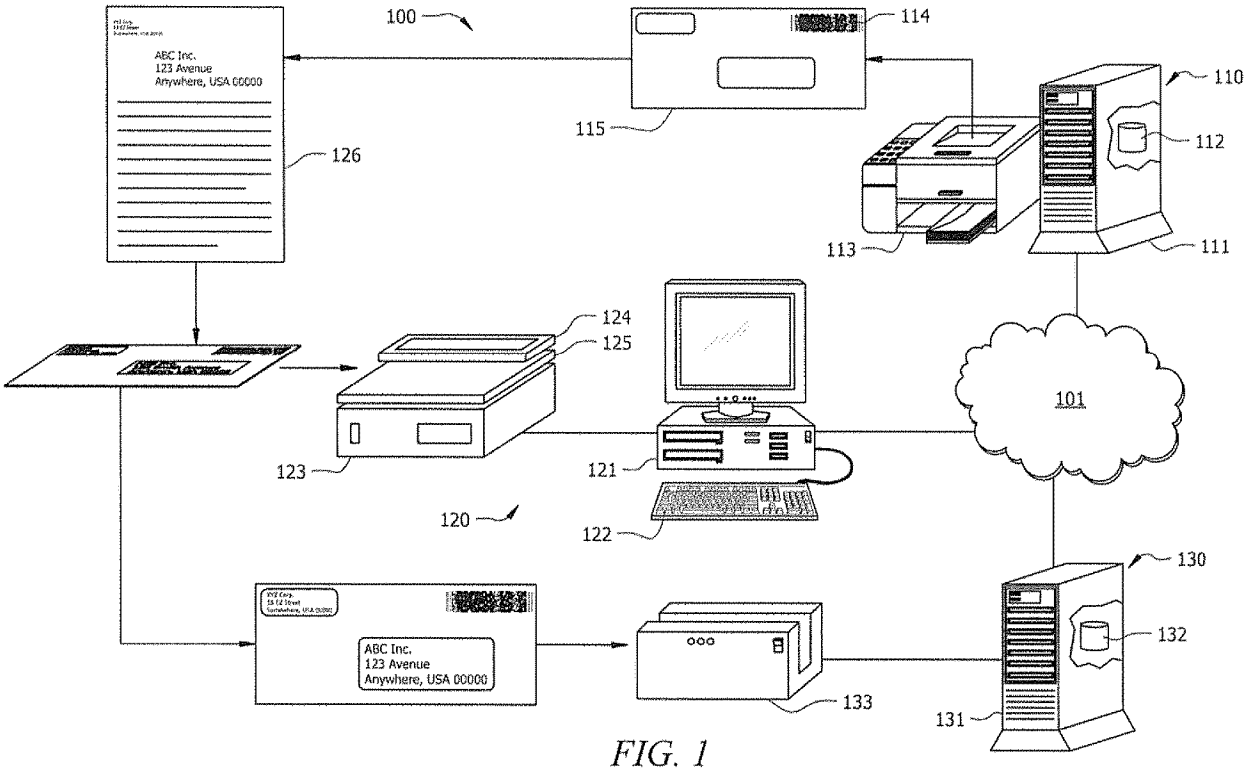
FIG. 1 shows a system adapted to provide distributed activation of pre-produced indicia according to an embodiment of the present invention.

Directing attention to FIG. 1, a system adapted to provide distributed activation of pre-produced indicia to thereby provide postage indicia according to an embodiment of the invention is shown as system 100. System 100 of the illustrated embodiment comprises activation server system 110, client system 120, and validation server system 130, in communication through network 101, cooperating to provide distributed activation and validation of pre-produced indicia.

Network 101 of the illustrated provides information communication between activation server system 110, client system 120, and validation server system 130. The foregoing systems may be disposed locally or remotely with respect to one another. For example, activation server system 110 and validation server system 130 may be disposed locally with respect to each other (e.g., at a postal system facility), whereas client system 120 may be disposed remotely with respect to activation server system 110 and validation server system 130 (e.g., at a private business or home). Of course, activation server system 110 and validation server system 130 may be disposed remotely with respect to each other, if desired. Accordingly, network 101 of embodiments may comprise the Internet, an intranet, an extranet, a local area network (LAN), a metropolitan area network (MAN), a wide area network (WAN), the public switched telephone network (PSTN), a wireless network, a cable transmission system, a satellite communication network, and/or the like.

Activation server system 110 preferably comprises a processor-based system, such as a computer having a central processing unit (CPU), memory (shown as including database 112), and appropriate input/output (I/O) devices and interfaces, operable under control of an instruction set defining operation as described herein. For example, activation server system 110 may comprise server platform 111 having a processor from the PENTIUM family of processors available from Intel Corporation, Santa Clara, Calif. Activation server system 110 of the illustrated embodiment provides generation, printing, and validation of indicia as described below. Accordingly, activation server system 110 of the illustrated embodiment includes database 112 for storage of pre-produced indicia identification and status and printer 113 for printing indicia on various stock, such as envelopes, labels, sheets of paper, etc.

Client system 120 preferably comprises a processor-based system, such as computers having a CPU, memory, and appropriate I/O devices and interfaces, operable under control of instruction sets defining operation as described herein. For example, client system 120 may comprise a computer platform 121 having a processor from the PENTIUM family of processors available from Intel Corporation, Santa Clara, Calif. Client system 120 preferably provides communication of pre-produced indicia information to activation server system 110 for activation of pre-produced indicia as postage indicia according to the concepts of the present invention. Accordingly, the illustrated embodiment of client system 120 includes scanner device 123 for scanning pre-produced indicia, as will be discussed in further detail below. Of course, other forms of input of information regarding pre-produced indicia may be utilized according to embodiments of the invention, such as keyboard 122.

Although shown as separate components in the illustrated embodiment, it should be appreciated that client system 120 may comprise different configurations than that shown. For example, scanner device 123 may comprise a processor-based system in an integrated device, such as may comprise an Internet appliance, operable to provide the functionality of client system 120 as described herein.

Validation server system 130 preferably comprises a processor-based system, such as a computer having a CPU, memory (shown as including database 132), and appropriate input/output (I/O) devices and interfaces, operable under control of an instruction set defining operation as described herein. For example, validation server system 130 may comprise server platform 131 having a processor from the PENTIUM family of processors available from Intel Corporation, Santa Clara, Calif. Validation server system 130 of the illustrated embodiment provides scanning and validation of postage indicia borne on mail pieces as described below. Accordingly, validation server system 130 of the illustrated embodiment includes database 132 for storage of validation information (e.g., pre-produced indicia identification and status) and mail piece scanner 133 for scanning and processing mail pieces.

It should be appreciated that configurations of validation server system 130 other than that illustrated may be utilized according to embodiments of the invention. For example, mail piece scanner 133 may be coupled to activation server system 110, such as through network 101, for performing validation as described herein without server platform 131, if desired.

Use of a validation system, such as validation server system 130, is optional according to embodiments of the invention. For example, where used to show when the pre-produced indicia has been activated are utilized, such marks may be relied upon to for validation of the indicia. However, to provide increased confidence as to the validity of such indicia, embodiments of the invention implement a validation system. In order to reduce the volume of processing associated with such a validation system, embodiments of the invention may operate to validate a random or statistical sampling of indicia, rather than each indicia activated.

Figure 2:
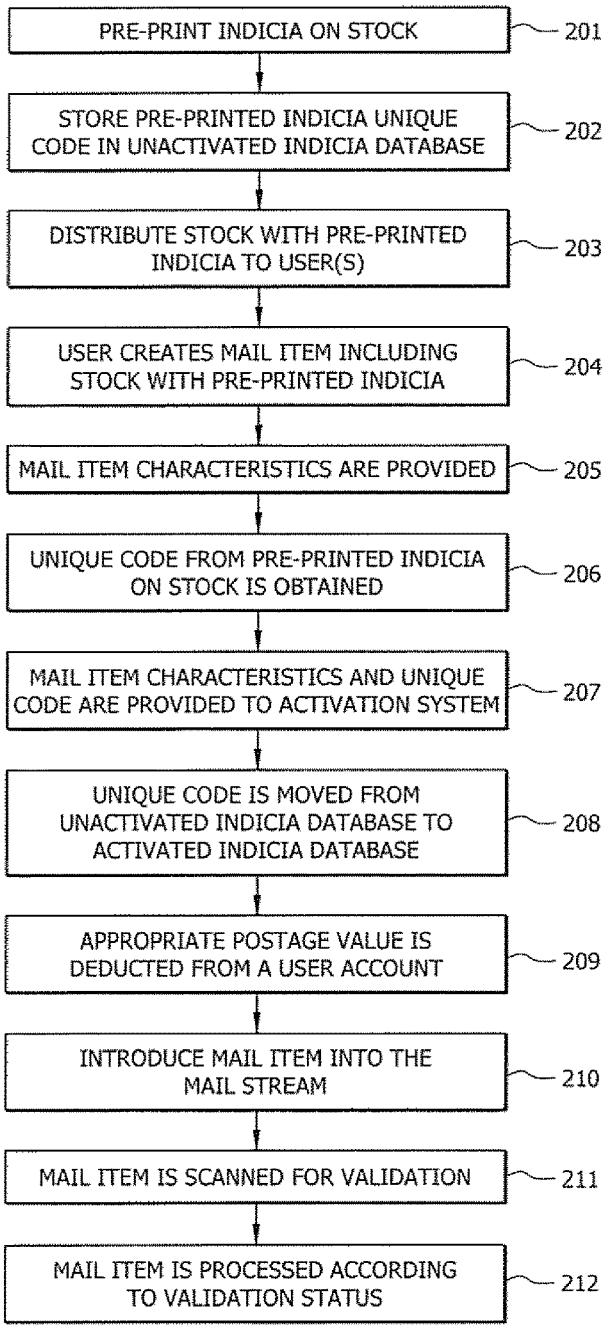
FIG. 2 shows a flow diagram of operation to provide activation of pre-produced indicia according to an embodiment of the present invention.

Operation of system 100 to apply indicia to fungible items, such as envelopes, paper stock, labels, etc., at a central location according to an embodiment of the present invention is represented in the flow diagram of FIG. 2. Activation server system 110 controls printer 113 to printing indicia upon various stock (block 201). It should be appreciated that, although the embodiment of system 110 illustrated in FIG. 1 shows use of a same server system for providing both printing of indicia and activating indicia, application of the concepts of the present invention are not limited to such a configuration. For example, printing of indicia as described herein may be provided by a system separate from that used in activating the pre-produced indicia as postage indicia, such as in an embodiment where envelope manufacturers include pre-produced indicia on various forms of envelopes and/or other stationary items at the time of manufacture.

Printer 113 of the illustrated embodiment is shown printing machine readable indicium 114 on envelope stock 115. Although windowed envelope stock (e.g., including glassine windows for viewing a return address and delivery address on a document placed within the envelope) is illustrated as envelope stock 115, embodiments of the invention may utilize different forms of stock. For example, non-windowed envelope stock, plain paper stock, letterhead stock, label stock, large envelope (flat) stock, and combinations thereof may be utilized according to embodiments of the invention.

Machine readable indicium 114 may comprise a bar code such as a PDF417 two dimensional barcode, a data matrix two dimensional barcode, a code 128 one dimensional barcode, a POSTNET (bar and half bar encoding) one dimensional barcode, and/or the like. Additional or alternative forms of machine readable symbology which may utilized according to embodiments of the invention include universal product code (UPC), code 93, dotcode, magnetic ink character recognition (MICR), etc. Indicia may additionally or alternatively be provided in other forms, such as human readable characters (e.g., letters, numerals, and/or symbols), graphic images, and/or the like.

A robust barcode such as the aforementioned PDF417 and data matrix barcodes are preferred according to embodiments of the invention in order to encode a relatively large amount of information therein, to provide data redundancy for error correction, to provide data security, etc. A one dimensional barcode such as the aforementioned POSTNET and code 128 barcodes are preferred according to some embodiments of the invention in order to provide encoded data in a form which is readily scanned using relatively inexpensive and/or which is widely available. Of course, multiple machine readable portions may be included as part of a machine readable indicium, such as to include a robust two dimensional barcode and a widely readable one dimensional barcode, to accommodate a large variety of use scenarios if desired.

Indicium 114 may be printed using media which is visible in natural light, which is invisible in natural light, or a combination thereof (e.g., partially visible in natural light and partially invisible in natural light) according to embodiments of the invention. For example, indicium 114 provided according to embodiments of the invention may be printed using traditional inks, toners, thermally activated components, etc. to provide an indicia which is visible in natural light. Additionally or alternatively, indicium 114 of embodiments of the invention may be printed using an ink which is invisible in natural light. Printed matter using such ink may be viewed using light of an appropriate wavelength, such as light in the ultraviolet spectrum. Additional detail with respect to indicia which is invisible in natural light is provided in the above referenced patent application entitled "Invisible Fluorescent Ink Mark."

Visibility of indicia which is initially invisible may be transient (e.g., visible only when light of the appropriate wavelength is present) or more permanent (e.g., chemically or molecularly changing to remain visible after light of the appropriate wavelength to "develop" the image is removed). For example, photo-chromatic compositions, such as those shown in U.S. Pat. No. 5,612,541, the disclosure of which is incorporated herein by reference, may be provided in inks used to print indicia. Such indicia may be invisible in natural light when printed. However, when the indicia is exposed to a proper developer, such as a ultraviolet light source of the appropriate wavelength, an appropriate amount of heat, an appropriate frequency of radio frequency energy, an appropriate chemical, a suitable magnetic field, etc., the indicia may become substantially permanently visible in natural light, thereby providing a bi-stable mark.

Indicium 114 preferably includes a code or other identifying information useful in uniquely identifying the indicium. For example, codes included in the pre-produced indicia may include serial or sequence numbers, identification information, digital signatures, cryptographic keys, and/or the like useful in uniquely identifying the pre-produced indicia and/or postage indicia represented thereby. Activation server system 110 preferably records such identification information in database 112 at block 202 of FIG. 2 so as to provide a database of pre-produced indicia, such as for use in activating and/or verifying the indicia.

According to embodiments of the invention additional information, such as the activation status of indicia, is additionally stored in database 112. For example, when indicia is generated, activation server system 110 may store a unique code identifying each generated indicia in database 112 along with a status identifier indicating the indicia are "unactivated". As discussed below, the status identifier may be updated upon activation of the indicia to indicate the indicia are "activated". Such status identifiers may be useful with respect to validation of the indicia, as discussed further below. Additional or alternative information which may be stored in association with indicia may include identification of an entity or account for which the indicia was generated (e.g., a business requesting the indicia for their use in mailing postal items), an entity generating the indicia (e.g., a service provider generating the indicia), identification of a system used to generate the indicia, cryptographic keys used for encrypting/decrypting information in the indicia, digital signatures used to authenticate the indicia, information regarding geographic areas mail items bearing the indicia may be introduced into a mail processing stream and/or geographic areas mail bearing the indicia may be delivered to, particular services and/or levels of service the indicia may be used for, and/or the like. Such additional information may be used in an audit trail with respect to any particular indicium, used to detect fraud or abuse of indicia, used for accounting purposes, used to restrict or manage the use of indicia, etc.

Although embodiments are described above with respect to providing information to identify an entity or account for which indicia was generated, indicia provided according to embodiments of the invention, both before activation and thereafter, may be anonymous (e.g., a user of the indicia is not identified by the indicia, as with a traditional postage stamp). Likewise, although embodiments are described above with respect to providing indicia which is geographically restricted (e.g., having a limitation with respect to a source and/or destination address associated with the use of the postage indicia), it should be appreciated that indicia provided according to embodiments of the invention may be geographically ambivalent (e.g., having no limitation with respect to a source or destination address associated with use of the postage indicia).

Figure 3A:
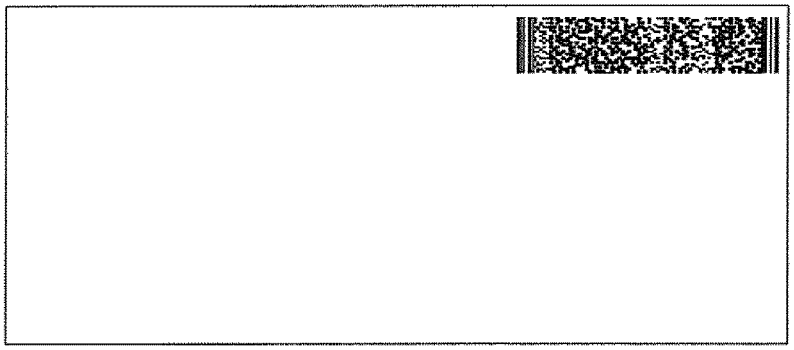
FIGS. 3A-3H show various pre-produced indicia as may be used according to embodiments of the invention.
Figure 3B:
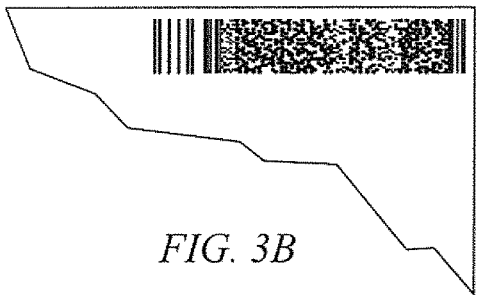
Figure 3C:
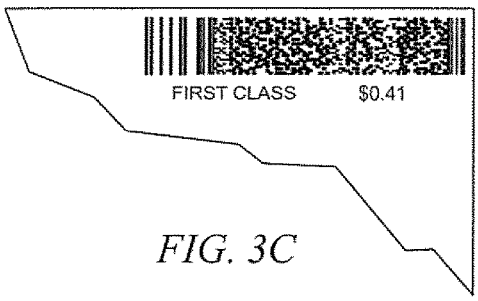
Figure 3D:
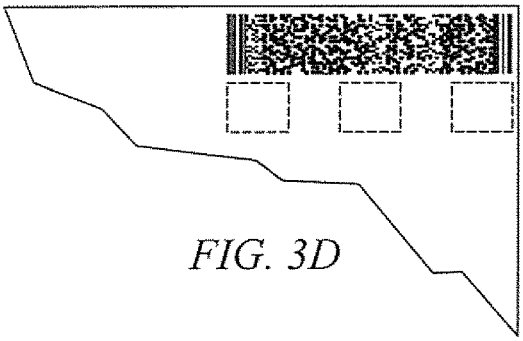
Figure 3E:
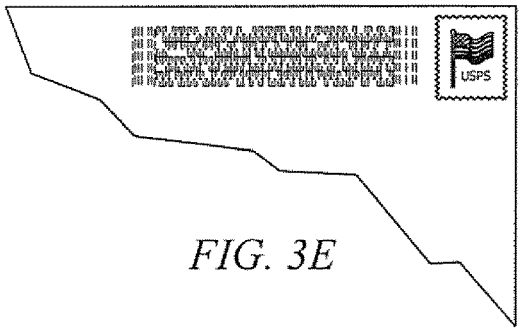
Figure 3F:
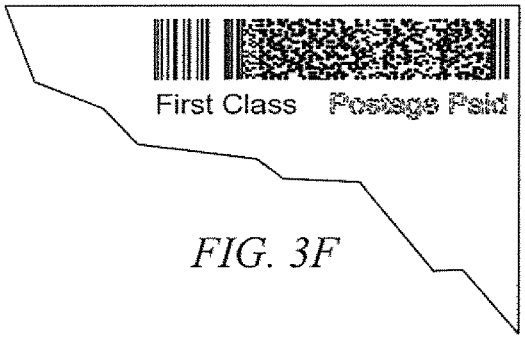
Figure 3G:
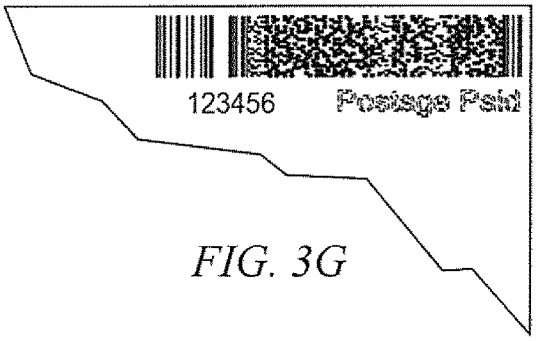
Figure 3H:
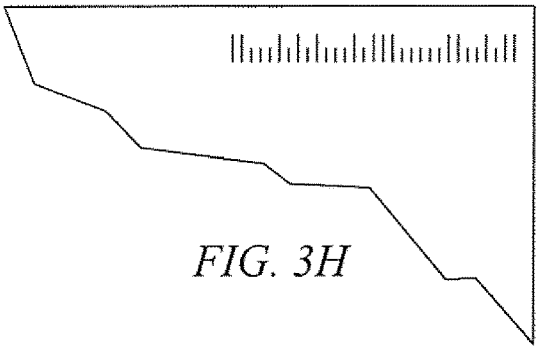

Indicia used according to embodiments of the invention may be printed alone or in combination with various images, information, characters, symbols, and/or marks (collectively referred to as marks). For example, indicia may be printed alone as shown in FIG. 3A (the example shown including a two dimensional barcode) and FIG. 3H (the example shown including a one dimensional barcode), indicia may be printed with one or more marks used to facilitate processing of indicia as shown in FIG. 3B (the example shown including a facing identification mark (FIM)), may be printed with human readable information as shown in FIG. 3C (the example shown including postal class and amount) FIG. 3G (the example shown including a human readable serial number for use in manual entry of a unique code as described herein) and FIG. 3F (the example shown including postal class), may be printed with one or more indicator marks as shown in FIG. 3D (the example shown with a plurality of bi-stable used as indicator marks) and FIGS. 3F and 3G (the examples shown including bi-stable text), may be printed with graphics or ornamentation as shown in FIG. 3E (the example shown including an ornamental representation of a traditional postage stamp). Such marks may be used in preparing mail items, processing mail items, for aesthetic or other purposes, and/or the like.

It should be appreciated that various marks used according to embodiments of the invention may be arranged, sized, or formed differently than those shown in the foregoing illustrative examples. For example, where human readable information, such as that of FIG. 3C, or an ornamental image, such as that of FIG. 3E, is provided in combination with an indicium which is invisible in natural light, the indicium may be printed to overlap the human readable information and ornamental image, as shown in information based indicia configurations shown and described in the above referenced patent application entitled "Invisible Fluorescent Ink Mark."

Figure 4:
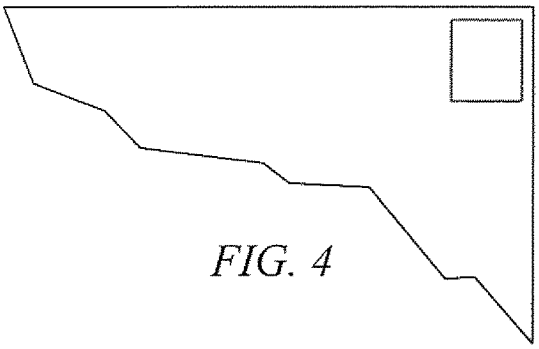
FIG. 4 shows pre-produced indicia as may be used according to an embodiment of the invention.

Moreover, the pre-produced indicia used according to embodiments may be provided in forms other than pre-printed embodiments. For example, pre-produced indicia utilized according to embodiments of the invention may comprise radio frequency identification (RFID) tags embedded in or affixed to stock as shown in FIG. 4.

The foregoing marks may be printed using media which is visible in natural light or which is invisible in natural light and may be printed using a same or different media than an accompanying pre-produced indicia. For example, a registration or orientation mark used to facilitate activation of the pre-produced indicia, such as by indicating an area in which the otherwise invisible pre-produced indicia is disposed, may be printed using an ink which is visible in natural light when the pre-produced indicia is printed in an ink which is not visible in natural light. A mark used to show when the pre-produced indicia has been activated may be printed in an ink which is not visible in natural light, irrespective of whether or not the pre-produced indicia is visible. Such a mark may be made visible in natural light upon activation of the pre-produced indicia using the aforementioned bi-stable media.

Items bearing pre-produced indicia are then preferably provided to a number of users for their use in posting mail items at block 203 of FIG. 2. For example, envelope stock 115 bearing indicium 114 may be provided to a user of client system 120, preferably as part of a plurality of items bearing pre-produced indicia provided to the user, for that user's later use in posting mail items.

Envelope stock 115 bearing indicium 114 is incorporated into a mail item or is selected for incorporation into a mail item by a user, such as by insertion of letter 126 therein with address information disposed in juxtaposition with the address windows of envelope stock 115, at block 204. Although the embodiment of envelope stock 115 shown having address windows therein, embodiments of the invention may not include any such windows, or all the windows illustrated. Accordingly, embodiments of the invention may operate to apply information to envelope stock 115, such as return address and/or destination address, as part of incorporating the envelope stock into a mail item. Such information may be applied by printing directly upon the stock, by applying printed labels to the stock, etc. Moreover, such information may be pre-printed on the stock, such as by a manufacture of envelope stock 115, if desired.

Various mail item characteristics, such as size, weight, class, return address, destination address, user account, desired postage, delivery instructions, etc. are collected in association with the mail item at block 205 of the illustrated embodiment. Such information may be collected automatically, such as through sensors (e.g., scales, scanners, etc.) coupled to client system 120 and/or may be provided through user input (e.g., using keyboard 122, a pointing device, voice input, etc.).

Indicium 114 is preferably scanned by client system 120 using scanner device 123 for activating the indicium as a postage indicium at block 206. It should be appreciated that, although scanning of indicium 114 is shown in the embodiment illustrated in FIG. 2 as occurring after a mail item including the stock bearing indicium 114 has been created, scanning of the indicium may be performed prior to actually creating the mail item (e.g., before inserting documents into envelope stock 115). Embodiments of the invention operate to scan indicium 114 after the mail item is complete in order to automatically collect mail item characteristics, such as mail item weight, contemporaneously therewith. It should be appreciated that, because indicium 114 is pre-produced, activation of indicium 114 as a postage indicium after documents have been inserted into envelope stock 115 does not present problems with respect to printing a valid, high quality indicium which is compatible with automated processing as would attempting to print a postage indicium on envelope stock 115 having documents inserted therein. Moreover, were specialized ink, such as the aforementioned invisible ink, or other specialized materials or apparatus are used in printing indicia, a user of embodiments of the present invention is not required to obtain such specialized materials or apparatus, and instead may utilize commonly available and widely used equipment such as a scanner.

Various forms of scanners may be utilized as scanner device 123 of embodiments of the invention. For example, traditional optical scanner configurations, such as may comprise flat bed scanners, sheet fed scanners, handheld scanners, camera based scanners, or the like may be used with respect to indicia which is visible in natural light. Where indicia is used which is not visible in natural light or which are configured to be bi-stable, scanners used according to the present invention may be adapted for use therewith, such as by substituting or adding an illumination lamp operable to radiate a desired wavelength of light (e.g., ultraviolet, infrared, etc.). However, lamps used with respect to many commonly available scanners are broad-spectrum enough to cause many ultraviolet and other inks to fluoresce, thereby making it possible in many circumstances to use more traditional optical scanner configurations even with respect to specialized indicia configurations.

It should be appreciated that adaptation to facilitate developing and/or scanning of pre-produced indicia according to embodiments of the invention is not limited to providing light of particular wavelengths. For example, apparatus for delivering chemicals, heat, radio frequency (RF) or magnetic energy, or other developers to a pre-produced indicia and/or accompanying marks may be used according to embodiments of the invention.

Scanners implemented according to embodiments of the invention may additionally or alternatively employ technology other than optical scanner technology. For example, RF scanner technology may be utilized with respect to indicia borne in RFID tags.

Although embodiments are described above with reference to scanner device 123 operating to scan indicium 114, it should be appreciated that the use of such a scanner may be omitted according to embodiments of the invention. For example, where indicium 114 comprises human readable information providing the aforementioned unique code or other suitable information, whether in combination with machine readable symbology or alone, a user may manually input the information into client system 120, such as through keyboard 122.

The illustrated embodiment of scanner device 123 not only includes scanning apparatus as discussed above, shown as scan head 124, but also includes additional apparatus useful with respect to processing pre-produced indicia according to concepts of the invention. Specifically, scanner device 123 includes scale 125 for weighing mail items for which pre-produced indicia is to be activated as postage indicia. Scanner device 123 of embodiments includes sensors, such as in the form of optical sensors (e.g., photodiodes) disposed at strategic positions through a platform (e.g., scale bed) or other structure of scanner device 123, for determining the size of mail items. Additional or alternative apparatus may be used, such as conveyer systems to move items for scanning, inserters for inserting items into envelopes to create mail items, printers for printing information such as addresses and/or activation status marks on mail items, etc.

Scanner device 123 preferably operates to scan indicium 114 to obtain information therein used for activation of the indicium as postage indicium. For example, a unique code included in the pre-produced indicia may thus be obtained and used to activate the pre-produced indicia. This unique code, perhaps accompanied by additional information such as a desired postage amount, postal item weight, postal class, origination location information, destination information, special handling instructions, user account information, etc., is preferably communicated from client system 120 to activation server system 110 as shown in block 207 of FIG. 2.

Scanner device 123, or other apparatus of client system 120, may additionally or alternatively operate to provide indication that indicium 114 has been activated. For example, where one or more bi-stable marks are included in association with indicium 114, as shown in FIG. 3D, scanner device 123 may operate to develop the mark (or an appropriate one of a plurality of marks) through exposure to a particular wavelength of light, an appropriate amount of heat, an appropriate frequency of radio frequency energy, an appropriate chemical, a suitable magnetic field, etc., upon activation of the indicium. For example, client system 120 may await a response from activation server system 110 indicating that the indicium has been activated and, thereafter, client system 120 may expose a mark to light for making the mark visible. This may provide a visible indication to the user as well as service provider personnel later handling the mail item that the indicium has at least been processed for activation. Such visible indication may be provided by the fact that a particular mark or symbol is visible. Additionally or alternatively, such visible indication may be provided in text (e.g., "Postage Paid") or other information made visible through the aforementioned developing.

Embodiments may employ different techniques to provide an indication that indicia has been activated, such as to impart a stamp, print a mark, cut a notch in the stock, etc. It should be appreciated that printing a mark one a complete mail item (e.g., an envelope having documents inserted therein) may be more readily implemented than printing a complete indicium because the indicium is likely to require a high quality, substantially undistorted print whereas the aforementioned mark merely need be present in most any form in order to serve its purpose. Marks applied or developed by client system 120 in association with activation of indicia may communicate information in addition to or in the alternative to an indication that the indicia has been activated. For example, a value of the activated indicia or range of values the activated indicia falls within may be indicated. In an embodiment were bi-stable marks are used, a first mark may indicate a lower range of value (e.g., \$0.01-\$0.99), a second mark may indicate a middle range of value (e.g., \$1.00-\$4.99), and a third mark may indicate a high range of value (e.g., \$5.00 and above). According to an alternative embodiment, segmented marks (e.g., similar to those of a seven segment liquid crystal display) may be provided in bi-stable media for selective developing (e.g., through illumination of a selected sequence or configuration of lamps) to produce a visible mark indicating the amount of postage and/or other information. Such marks may be selectively developed, such as by exposure to different wavelengths of light, different exposure times, etc.

The foregoing bi-stable marks need not be utilized to provide the foregoing information or other information on the mail items at the time of activation according to embodiments of the invention. For example, a mark printed by scanner device 123, or other apparatus of client system 120, may print symbols indicating ranges, may print an exact value, etc.

Activation server system 110 preferably operates to change the status of indicium 114 from "unactivated" to "activated" as shown in block 208 of FIG. 2. For example, activation server system 110 may locate the unique code or other information provided by client system 120 in database 112 and change status information associated therewith, such as by changing a status indicator stored in association with the unique code, by moving the unique code from an "unactivated" portion of the database to an "activated" portion of the database, and/or the like. Such a change in status according to embodiments of the invention results in the indicium becoming a valid postage indicium or a value bearing indicium. Activation server system 110 may communicate the fact that the indicium has been activated and/or other information, such as a value of the activated indicium, to client system 120 for use thereby as described herein.

Embodiments of activation server system 110 operate to do more than change a status of a database record associated with indicium 114. For example, embodiments of the invention may utilize information provided with the aforementioned unique code, such as postal item weight, postal class, origination location information, destination information, and/or special handling instructions, in order to rate the mail piece for an appropriate postal value. As shown in block 209 of FIG. 2, activation server system 110 may additionally or alternatively operate to debit an account (or otherwise account for postage value) for the appropriate postal value, such as using the aforementioned determined rate or the desired postage amount transmitted with the unique code. Embodiments of the invention may collect value or fees in addition to a postage amount, such as to collect a surcharge for use of pre-produced indicia as described herein. Additional functions, such as dispatching a courier to retrieve mail items, scheduling postal processing resources, providing reports, etc. may be performed by or in response to activation server system 110 activating indicia.

Accounting for postage value (e.g., debiting a prepaid account, incrementing an ascending register and/or decrementing a descending register in a postage security device, incrementing a post-paid account balance, etc.) and/or collecting value in addition to postage amounts may be performed prior to activation of the indicia, at the time of activation of the indicia, or after activation of the indicia according to embodiments of the invention. Detail with respect to accounting for postage value as may be utilized according to embodiments of the invention is shown in the above referenced patent application entitled "Virtual Security Device."

Although embodiments are described herein with reference to deducting an amount of postage value in association with activation of a particular pre-produced indicia as postage indicia, embodiments of the invention may not implement value accounts in association with indicia activation. For example, indicia provided according to embodiments of the present invention may be of predetermined value (e.g., a common postage value, such as $0.41 assigned at the time of printing the pre-produced indicia), thereby providing a pre-paid postage amount which may be collected at the time of purchasing the stock bearing the indicia.

Embodiments of activation server system 110 preferably further operate to facilitate later accounting for and/or validating activated indicia. For example, activation server system 110 may provide access to, or information from, database 112 to validation server system 130 for use in validating indicia which have been introduced into the mail processing stream. Mail piece scanner 133 of validation server system 130 may later obtain information from the indicia for use with the foregoing information (e.g., comparison of the scanned information to the stored information) in order to validate the indicia. Mail piece scanner 133 may thus comprise traditional optical scanner configurations, such as flat bed scanners, sheet fed scanners, handheld scanners, camera based scanners, or the like when indicia which is visible in natural light are used. As with scanner device 123 discussed above, where indicia is used which is not visible in natural light, mail piece scanners used according to the present invention may be adapted for use therewith, such as by substituting or adding an illumination lamp operable to radiate a desired wavelength of light (e.g., ultraviolet, infrared, etc.). Likewise, mail piece scanners implemented according to embodiments of the invention may additionally or alternatively employ technology other than optical scanner technology, such as RF scanner technology where RFID tags are used.

According to an embodiment of the invention, activation server system 110 transmits information identifying activated indicia (e.g., the unique codes of activated indicia) to validation server 130 (as may be stored in database 132) for use in validating indicia introduced into the mail processing stream. Additionally or alternatively, activation server system 110 may provide access to information identifying activated indicia within database 112 to validation server 130 for use in validating indicia introduced into the mail processing stream. According to these embodiments, as a mail item is processed (e.g., at a mail service provider's mail processing station) after the mail item has been introduced into the mail stream (block 210 of FIG. 2) the mail piece is passed through mail piece scanner 133 for scanning indicium 114 to obtain information such as the aforementioned unique code (block 211 of FIG. 2). Validation server system 130 may compare this information to information in database 132 and/or database 122 to determine if the indicium is a valid postage indicium. If the indicium is valid (e.g., is activated), validation server system 130 (at block 212 of FIG. 2) may allow the mail item to pass for further processing (e.g., processing for delivery to an appropriate destination address). However, if the indicium is not valid (e.g., is unactivated), validation server system 130 (at block 212 of FIG. 2) may prevent further processing (e.g., direct the mail item to a "return to sender" bin) and/or may provide additional processing, as described in further detail below. Various audit processing may also be performed by activation sever system 110 and/or validation server system 130, such as to detect fraud or abuse of indicia, used for accounting purposes, etc., using the aforementioned indicia information during processing of mail items or thereafter.

Validation server system 130 of embodiments of the invention operates to transmit information identifying indicia processed as part of the mail stream (e.g., the unique codes of scanned at block 211 of FIG. 2) to activation server system 110 for use in validating indicia. Such transmission of indicia identifying information may occur in real-time, as a mail item is being processed, or in batch, after a plurality of mail items have been processed. Activation server system 110 may use the information provided by validation server system 130, such as by comparing it to information in database 122, to determine if the indicia is valid postage indicia. During real-time validation, activation server system 110 may report invalid indicia to validation server system 130 to prevent further processing of the mail item, to create a record of use of invalid postage, and/or to providing appropriate additional processing (block 212 of FIG. 2). Where such validation is delayed, such as due to batch communication of indicia information, audit processing may be utilized to identify a source (e.g., user, account, client system, etc.) of fraudulent or misused indicia for addressing such uses in the future, for recovering postal value, for reporting purposes, etc.

Processing of indicia which validation server system 130 determines to be unactivated may comprise more than rejecting the mail item for delivery. For example, validation server system 130, perhaps in cooperation with activation server system 110 and/or client system 120, may operate to decrement an appropriate account (e.g., the appropriate users' account, an account of a service provider providing the pre-produced indicia, etc.) or otherwise issue an invoice or collect for the postal value. Collection of postal value in such a situation may not be limited to the actual postage amount, but may include a surcharge associated with misuse of the indicia. Such additional processing may additionally or alternatively include notifying a user of the detected misuse of indicia, statistical analysis of indicia usage (e.g., to detect fraud or attempted fraud), etc.

In addition to or in the alternative to validation server system 130 scanning mail items after their introduction into the mail stream, embodiments of the invention may operate to perform at least some level of validation at or very near the time a mail item is introduced into the mail stream. For example, a postman initially picking up a mail item for entry into the mail stream may make a determination as to whether the indicia has been activated (e.g., through reference to one or more visible bi-stable mark, through scanning the indicia, etc.) and/or whether the indicia has the appropriate amount of postage value for the mail item (e.g., through reference to a visible indication of postage value, through scanning the indicia, etc.). Accordingly, the postman may be provided with various devices useful according to embodiments of the invention, such as a portable version of mail piece scanner 133.

From the above it can be seen that operation according to the embodiment of FIG. 2 provides postage indicia for mailing documents using pre-produced indicia. The use of such pre-produced indicia may provide advantages over traditional metering applications in that specialized printing equipment is not needed by the users, proper amounts of postage may be acquired after mail items have been completed without the risk of indicia printed thereon being distorted or otherwise unacceptable and without the need for complicated printing equipment. Moreover, anonymous postage, more akin to traditional postage stamps, may be readily provided according to the foregoing. Specialized indicia, such as may use invisible ink and/or bi-stable ink, may readily be used without requiring users to obtain special printing equipment.

Although embodiments have been described herein with reference to the use of printed indicia, it should be appreciated that other forms of indicia may be utilized according to embodiments of the invention. For example, RFID tags may be applied to or embedded in stock for use according to the concepts of the present invention.

It should be appreciated that, although embodiments have been described above with reference to use of indicia in a postage context, the concepts of the present invention may be utilized outside of a postal system. For example, indicia activated according to embodiments of the present invention to become value bearing indicia may be used with respect to various transactions, such as in business commerce.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method comprising:

generating, by a processor-based system, a plurality of fungible stock pieces, each fungible stock piece of the plurality of fungible stock pieces having a pre-produced indicium thereon, wherein each said pre-produced indicium includes substantially unique identifying information that identifies a fungible stock piece of said plurality of fungible stock pieces corresponding to said pre-produced indicium and an entity that requested generation of said fungible stock piece;

storing, by the processor-based system, said substantially unique identifying information and status information for each fungible stock piece of said plurality of fungible stock pieces as records in a database, wherein, for a particular fungible stock piece of said plurality of fungible stock pieces, said status information indicates whether a particular pre-produced indicium corresponding to said particular fungible stock piece is in an unactivated state or an activated state, wherein said status information for said particular pre-produced indicium indicates the unactivated state when said particular pre-produced indicium is generated, and wherein said unactivated pre-produced indicium includes said substantially unique identifying information identifying said entity that requested said generation of said fungible stock piece;

receiving, by said processor-based system, one or more requests to activate one or more pre-produced indicia corresponding to one or more fungible stock pieces of said plurality of fungible stock pieces, wherein each of said one or more requests comprises substantially unique identifying information corresponding to a particular fungible stock piece of said one or more fungible stock pieces and mail item information associated with a mail item that comprises said particular fungible stock piece, and wherein each of said one or more fungible stock pieces is identified by said substantially unique identifying information included in said one or more requests;

in response to receiving said one or more requests, activating each of said one or more pre-produced indicia, said activating comprising:

charging, by said processor-based system, one or more accounts for activation of each of said one or more pre-produced indicia, wherein each account is charged a value determined based on said mail item information corresponding to a particular pre-produced indicium, and wherein, for a particular indicium of said one or more pre-produced indicia, a particular account to be charged is identified based on said substantially unique identifying information that identifies said entity that requested generation of a particular fungible stock piece that includes said particular indicium; and modifying, by said processor-based system, one or more records in said database, wherein said modifying is configured to change status information corresponding to each of said one or more pre-produced indicium associated with said one or more fungible stock pieces from said unactivated state to said activated state, said modifying including changing at least one data field associated with said one or more records from said unactivated state to said activated state;

validating, by said processor-based system, an activation status of one or more pre-produced indicia associated with mail items placed in a mail stream, wherein said validating comprises:

determining, by said processor-based system, whether a mail item placed in said mail stream comprises a pre-produced indicium that has not been activated;

in response to determining that said mail stream includes a mail item having a pre-produced indicium that has not been activated:

determining, by said processor-based system, an entity identified by substantially unique identifying information included in said unactivated pre-produced indicium;

modifying, by said processor-based system, a record corresponding to said unactivated pre-produced indicium to change status information corresponding to said unactivated pre-produced indicium from said unactivated state to said activated state, said modifying said record including changing a data field associated with said record from said unactivated state to said activated state; and charging, by said processor-based system, an account for activation of said unactivated pre-produced indicium, wherein said account is identified based on said entity identified by said substantially unique identifying information included in said unactivated pre-produced indicium.

2. The method of claim 1, wherein said plurality of fungible stock pieces comprise envelope stock.

3. The method of claim 1, wherein said pre-produced indicia comprise a barcode symbology.

4. The method of claim 1, wherein said pre-produced indicia comprise radio frequency identification tags.

5. The method of claim 1, wherein said substantially unique identifying information comprises a substantially unique code.

6. The method of claim 1, wherein said activating comprises:

providing information confirming activation of at least one pre-produced indicium of said one or more pre-produced indicia to a user system, wherein said user system is configured to print a mark on a fungible stock piece corresponding to said at least one pre-produced indicium, wherein said mark is utilized to validate activation of said at least one pre-produced indicium.

7. The method of claim 1, wherein said activated pre-produced indicium comprises a postage indicium.

8. The method of claim 7, further comprising:

determining an amount for said value using said mail item information.

9. The method of claim 8, wherein said charging said account comprises:

debiting value from a postage security device.

10. The method of claim 1, wherein said validating comprises:

scanning pre-produced indicia associated with one or more mail items placed in said mail stream to obtain at least a portion of said substantially unique identifying information.

11. The method of claim 10, wherein said determining whether a mail item placed in said mail stream comprises a pre-produced indicium that has not been activated comprises:

determining, by said processor-based system, an activation status of said pre-produced indicium of said mail item based on said database and said at least a portion of said substantially unique identifying information.

12. The method of claim 1, wherein said charging said account for said activation of said unactivated pre-produced indicium comprises:

debiting said account for a surcharge associated with activating unactivated pre-produced indicium after said mail item has been introduced into said mail stream.

13. The method of claim 1, wherein said validating comprises:

determining, by said processor-based system, whether said mail item placed in said mail stream comprises a pre-produced indicium that has been activated based on substantially unique identifying information included in said pre-produced indicium of said mail item and said database; and in response to determining that said mail item placed in said mail stream includes a pre-produced indicium that has been activated, processing said mail item through said mail stream.

14. A method comprising:

obtaining one or more pieces of fungible stock, wherein each piece of fungible stock of said one or more pieces of fungible stock includes a pre-produced indicium thereon, wherein said pre-produced indicium for each of said one or more pieces of fungible stock includes substantially unique identifying information that identifies a piece of fungible stock corresponding to said pre-produced indicium and an entity that requested generation of said fungible stock piece;

selecting a piece of said fungible stock of said one or more pieces of fungible stock for use with an item;

scanning, by a scanner device, a pre-produced indicium of said selected piece of fungible stock to obtain substantially unique identifying information included in said pre-produced indicium, wherein said substantially unique identifying information in said pre-produced indicium indicates that the pre-produced indicium is in an unactivated state, and wherein said unactivated pre-produced indicium includes said substantially unique identifying information identifying said entity that requested said generation of said fungible stock piece;

transmitting, by a processor-based system communicatively coupled to said scanner device, a request to activate said pre-produced indicium of said selected piece of fungible stock as a value bearing indicium to an activation system, wherein said request comprises at least a portion of said substantially unique identifying information of said pre-produced indicium of said selected piece of fungible stock and information indicating an activation value corresponding to an amount to be charged, by said activation system, to an account of an entity identified by said at least a portion of said substantially unique identifying information for said activation of said pre-produced indicium of said selected piece of fungible stock as said value bearing indicium, wherein said request to activate causes said activation system to:

charge said amount to said account of said entity; and modify a record corresponding to said unactivated pre-produced indicium, in a database, wherein said modifying is configured to change status information corresponding to said pre-produced indicium from said unactivated state to an activated state, said modifying including changing a data field associated with said record from said unactivated state to said activated state;

printing, by said processor-based system, a mark on said selected piece of fungible stock, wherein said mark indicates a range of values within which said amount charged for activation of said pre-produced indicium of said selected piece of fungible stock as said value bearing indicium; and using said selected piece of fungible stock in a transaction requiring a value bearing indicium, wherein, during said transaction, said mark provides an indication of said activation said pre-produced indicium of said selected piece of fungible stock as said value bearing indicium.

15. The method of claim 14, wherein said pre-produced indicium comprises at least one of a barcode symbology and a radio frequency identification tag.

16. The method of claim 14, wherein said selected piece of fungible stock comprises envelope stock, and wherein said selecting comprises:

inserting said item into said envelope stock to create a mail item.

17. The method of claim 16, wherein said mark is printed after said inserting said item into said envelope stock to create said mail item.

18. The method of claim 14, wherein said value bearing indicium comprises a postage indicium.

19. The method of claim 14, wherein the range of values indicated by said mark printed on said selected piece of fungible stock corresponds to one of a plurality of different ranges of values.

20. The method of claim 16, wherein said transaction includes placing said mail item in a mail stream, and wherein an entity operating said mail stream validates processing of said mail item through said mail stream based on said mark.

21. A system comprising:

a plurality of fungible stock pieces, wherein each fungible stock piece of said plurality of fungible stock pieces has a pre-produced indicium associated therewith, and wherein each pre-produced indicium includes information that identifies an entity that requested generation of said pre-produced indicium;

a first scanner system comprising a scanner, a scale, and a stock piece marking apparatus, wherein said first scanner system is configured to:

scan, via said scanner, a pre-produced indicium associated with a selected fungible stock piece of said plurality of fungible stock pieces;

weigh, via said scale, an item which will bear said pre-produced indicium of said selected fungible stock piece; and mark, via said stock piece marking apparatus, said selected fungible stock piece to visibly indicate activation of said pre-produced indicium of said selected fungible stock piece, wherein said mark is configured to indicate a validity status of said pre-produced indicium of said selected fungible stock piece, wherein said validity status indicates whether said pre-produced indicium of said selected fungible stock piece has been activated as a value bearing indicium; and an activation system configured to:

store said information that identifies said entity and validity status information for each fungible stock piece of said plurality of fungible stock pieces as records in a database, wherein, for a particular fungible stock piece of said plurality of fungible stock pieces, said validity status information indicates whether a particular pre-produced indicium corresponding to said particular fungible stock piece is in an unactivated state or an activated state, wherein said validity status information for said particular pre-produced indicium indicates said unactivated state when said particular pre-produced indicium is generated, and wherein said unactivated pre-produced indicium includes substantially unique identifying information identifying said entity that requested said generation of said fungible stock piece;

activate, responsive to a request, said pre-produced indicium of said selected fungible stock piece as said value bearing indicium using at least a portion of information obtained from said pre-produced indicium by said first scanner system, wherein, upon successful activation of said pre-produced indicium of said selected fungible stock piece, said pre-produced indicium is said value bearing indicium and a record corresponding to said pre-produced indicium of said selected fungible stock piece is modified to change said validity status information from said unactivated state to said activated state, wherein changing said validity status information includes changing a data field associated with said record from said unactivated state to said activated state; and a validation system communicatively coupled to said activation system and configured to:

determine whether a mail item placed in a mail stream comprises a pre-produced indicium that has not been activated, wherein said pre-produced indicium corresponds to a fungible stock piece of said plurality of fungible stock pieces;

in response to determining that said mail stream includes a mail item having a pre-produced indicium that has not been activated:

determine an entity identified by substantially unique identifying information included in said pre-produced indicium that has not been activated; and in cooperation with said activation system, modify a record corresponding to said unactivated pre-produced indicium to change validity status information corresponding to said unactivated pre-produced indicium from said unactivated state to said activated state, and charge an account for activation of said unactivated pre-produced indicium, wherein said account is identified based on said information included in said unactivated pre-produced indicium that identifies said entity, and wherein changing said validity status information includes changing said data field associated with said record from said unactivated state to said activated state.

22. The system of claim 21, wherein said plurality of fungible stock pieces comprise a plurality of mailing stock, wherein said value bearing indicium comprises a postage indicium.

23. The system of claim 22, wherein said scanner comprises a mail item scanner having a scan head adapted to scan said pre-produced indicium and said first scanner system comprises a postal item size sensor configured to determine a size of mail items.

24. The system of claim 21, wherein said scale comprises a postal scale, wherein said postal scale and said scanner are integrated into a single unit configured to determine an appropriate postage amount using weight information.

25. The system of claim 21, further comprising:

a second scanner system configured to scan pre-produced indicia borne by mail items placed in said mail stream.

26. The system of claim 21, wherein said validation system is configured to:

determine whether said mail item placed in said mail stream comprises a pre-produced indicium that has been activated based on substantially unique identifying information included in said pre-produced indicium of said mail item and said database; and process said mail item through said mail stream in response to determining that said mail item placed in said mail stream includes a pre-produced indicium that has been activated.

* * * * *